US009376189B1

(12) United States Patent
De Henau et al.

(10) Patent No.: US 9,376,189 B1
(45) Date of Patent: Jun. 28, 2016

(54) TRIM AND REVERSE SYSTEM FOR A WATERCRAFT JET PROPULSION SYSTEM

(71) Applicant: BOMBARDIER RECREATIONAL PRODUCTS INC., Valcourt (CA)

(72) Inventors: Jean-Luc De Henau, Granby (CA); Sebastien Quirion, Magog (CA); Michel Bourret, Drummondville (CA); Jean-Philippe Gendron, Granby (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 228 days.

(21) Appl. No.: 13/902,321

(22) Filed: May 24, 2013

Related U.S. Application Data

(60) Provisional application No. 61/651,073, filed on May 24, 2012.

(51) Int. Cl.
*B63H 11/11* (2006.01)
*B63H 11/113* (2006.01)

(52) U.S. Cl.
CPC ..... *B63H 11/113* (2013.01); *B63H 11/11* (2013.01)

(58) Field of Classification Search
CPC ..... B63H 11/113; B63H 11/107; B63H 11/11
USPC ..... 440/39–43; 114/284–286, 288, 289
See application file for complete search history.

(56) References Cited

U.S. PATENT DOCUMENTS 5,154,650 A 10/1992 Nakase
5,304,078 A 4/1994 Kaneko
5,474,007 A 12/1995 Kobayashi
5,494,464 A 2/1996 Kobayashi et al.
5,507,672 A 4/1996 Imaeda
5,752,864 A 5/1998 Jones et al.
5,755,601 A 5/1998 Jones
5,879,209 A 3/1999 Jones
5,934,954 A 8/1999 Schott et al.
6,045,418 A 4/2000 Roos
6,113,443 A 9/2000 Eichinger
6,234,100 B1 5/2001 Fadeley et al.
6,267,633 B1 7/2001 Suganuma
6,305,307 B1 10/2001 Yokoya
6,350,163 B1 2/2002 Fujimoto
6,401,644 B2 6/2002 Fadeley et al.
6,453,835 B2 9/2002 Fadeley et al.
6,533,623 B2 3/2003 Simard et al.
6,547,611 B1 4/2003 Boroos et al.
6,676,462 B2 1/2004 Yanagihara
6,722,632 B2 4/2004 Kenny et al.
6,729,918 B2 5/2004 Fuse et al.
(Continued)

*Primary Examiner* — Andrew Polay
(74) *Attorney, Agent, or Firm* — BCF LLP

(57) ABSTRACT

A watercraft has a hull, a deck, an engine compartment, an engine disposed in the engine compartment, a steering assembly, a jet pump, a venturi connected to the jet pump, a variable trim system (VTS) support rotationally mounted relative to the venturi about a VTS axis, a steering nozzle rotationally mounted to the VTS support about a steering axis, and a gate rotationally mounted relative to the venturi about a gate axis. The gate is operatively connected to the VTS support such that rotation of the gate about the gate axis results in rotation of the VTS support about the VTS axis. An actuator is operatively connected to the gate to rotate the gate about the gate axis. The gate is operatively connected between the actuator and the VTS support. A jet propulsion system and a variable trim system and gate assembly are also disclosed.

26 Claims, 33 Drawing Sheets

(56) References Cited

U.S. PATENT DOCUMENTS

| | | | | |
|---|---|---|---|---|
| 6,743,062 | B1 | 6/2004 | Jones | |
| 6,875,065 | B2 | 4/2005 | Tsuchiya et al. | |
| 6,886,529 | B2 | 5/2005 | Suzuki et al. | |
| 6,905,378 | B2 | 6/2005 | Uraki et al. | |
| 6,905,381 | B2 | 6/2005 | Araki et al. | |
| 7,018,251 | B2 | 3/2006 | Iwakami et al. | |
| 7,166,003 | B2 | 1/2007 | Motose | |
| 7,195,527 | B2 | 3/2007 | Tani et al. | |
| 7,201,620 | B2 | 4/2007 | Kinoshita et al. | |
| 7,674,144 | B2 | 3/2010 | Bourret et al. | |
| 7,708,609 | B2 | 5/2010 | Plante et al. | |
| 7,775,744 | B1 | 8/2010 | Lares | |
| 7,775,844 | B2 | 8/2010 | St-Pierre et al. | |
| 7,841,915 | B2 | 11/2010 | Bourret et al. | |
| 7,892,053 | B2 | 2/2011 | St-Pierre et al. | |
| 8,000,851 | B2 | 8/2011 | St-Pierre et al. | |
| 8,177,594 | B2 | 5/2012 | Dagenais et al. | |
| 2003/0077954 | A1 | 4/2003 | Fadeley et al. | |
| 2008/0182463 | A1* | 7/2008 | St-Pierre et al. | 440/1 |
| 2009/0264029 | A1 | 10/2009 | Dagenais et al. | |
| 2010/0041286 | A1* | 2/2010 | Bourret et al. | 440/41 |
| 2012/0021660 | A1 | 1/2012 | St-Pierre et al. | |

* cited by examiner

TRIM AND REVERSE SYSTEM FOR A WATERCRAFT JET PROPULSION SYSTEM

CROSS-REFERENCE

The present application claims priority to U.S. Provisional Patent Application 61/651,073, filed May 24, 2012, the entirety of which is incorporated herein by reference.

FIELD OF THE INVENTION

The present invention relates to watercraft propelled by jet propulsion systems having a variable trim system and a reverse gate.

BACKGROUND

There exist many different ways to propel watercraft. One way is to use what is known as a jet propulsion system which is powered by an engine of the watercraft. The jet propulsion system typically consists of a jet pump which pressurizes water from the body of water and expels it through a venturi as a jet rearwardly of the watercraft to create thrust. Usually, a steering nozzle is pivotally mounted rearwardly of the venturi. The steering nozzle is operatively connected to a steering assembly of the watercraft which causes it to turn left or right to redirect the jet of water and thereby steer the watercraft.

To be able to move in the reverse direction, the jet propulsion system of these watercraft are usually provided with a reverse gate. The reverse gate is movable between stowed positions and reverse positions. In the stowed positions, the reverse gate does not interfere with the jet of water coming from the steering nozzle, thus allowing the watercraft to move forward. In the reverse positions, the reverse gate redirects the jet of water coming from the steering nozzle towards a front of the watercraft, thus causing the watercraft to move in a reverse direction. The reverse gate is typically manually activated by the driver via a lever positioned near the driver. Cables and linkages are used to connect the lever with the reverse gate. In some watercraft, the lever is electrically connected to an electric motor which moves the reverse gate between its various positions.

Some watercraft are also provided with a variable trim system (VTS) which allows the adjustment of the orientation of the watercraft (about a laterally extending axis) with respect to the water as the watercraft is moving. In one type of VTS, the steering nozzle is gimballed and can pivot about a horizontal axis to redirect the jet of water slightly up or down to adjust the trim. A VTS can be mechanically or electrically activated. In mechanical versions, a finger activated lever on the steering assembly is connected to a push-pull cable linked to the gimbal. The lever causes the cable to push or pull on the gimbal and thus rotate the steering nozzle in the desired direction. In other versions, a pull-pull cable is used. Other mechanical versions are available which are accessible from the rear of the watercraft. In electric versions, an electric motor is operatively connected to the gimbal so as to rotate it to obtain the desired position of the steering nozzle. Buttons located near the steering assembly send electrical signals to the electric motor to control the position of the steering nozzle.

Although a VTS and a reverse gate are often both provided in jet propulsion systems, each is provided with its own independent mechanism and actuation system. This can lead to increased complexity and increased cost due to the number of parts necessary. Also, the space available around a jet propulsion system is typically minimal and providing two separate mechanisms (one for the VTS and one for the reverse gate) can prove difficult.

Therefore, there is a need for a watercraft and a jet propulsion for a watercraft which has a VTS and a reverse gate which does not require two independent mechanisms and actuation systems.

SUMMARY

It is an object of the present invention to ameliorate at least some of the inconveniences present in the prior art.

In one aspect, a watercraft has a hull, a deck disposed on the hull, an engine compartment defined between the hull and the deck, an engine disposed in the engine compartment, a steering assembly disposed at least in part on the deck, a jet pump connected to the hull and being operatively connected to the engine, a venturi connected to a rearward end of the jet pump, a variable trim system (VTS) support rotationally mounted relative to the venturi about a VTS axis, the VTS axis extending generally laterally and horizontally, a steering nozzle rotationally mounted to the VTS support about a steering axis such that the steering nozzle rotates about the VTS axis with the VTS support, the steering axis being generally perpendicular to the VTS axis, the steering nozzle being operatively connected to the steering assembly and being disposed at least in part rearwardly of the venturi, a gate rotationally mounted relative to the venturi about a gate axis, the gate axis extending generally laterally and horizontally, the gate being operatively connected to the VTS support such that rotation of the gate about the gate axis results in rotation of the VTS support about the VTS axis, and an actuator operatively connected to the gate to rotate the gate about the gate axis, the gate being operatively connected between the actuator and the VTS support.

In a further aspect, at least one follower extends from one of the VTS support and the gate. At least one abutment surface is disposed on an other one of the VTS support and the gate. The at least one follower abuts the at least one abutment surface through at least a range of rotation of the gate. Rotation of the gate about the gate axis results in a displacement of the at least one follower along the at least one abutment surface. The displacement of the at least one follower along the at least one abutment surface results in rotation of the VTS support about the VTS axis.

In an additional aspect, the at least one abutment surface is disposed on the gate and the at least one follower is disposed on the VTS support.

In a further aspect, the at least one abutment surface is at least one first abutment surface. The watercraft also has at least one second abutment surface disposed on the other one of the VTS support and the gate. The at least one second abutment surface extends from the at least one first abutment surface. Rotation of the gate about the gate axis through a first range of angles results in the displacement of the at least one follower along the at least one first abutment surface. The displacement of the at least one follower along the at least one first abutment surface results in rotation of the VTS support about the VTS axis. Rotation of the gate about the gate axis through a second range of angles results in a displacement of the at least one follower along the at least one second abutment surface. The displacement of the at least one follower along the at least one second abutment surface maintaining the VTS support in position.

In an additional aspect, the displacement of the at least one follower along the at least one second abutment surface maintains the VTS support in a fully lowered position.

In a further aspect, the at least one second abutment surface is an arcuate surface having the gate axis as a center of curvature.

In an additional aspect, the at least one first abutment surface is straight.

In a further aspect, rotation of the gate between a first angle and a second angle causes a rotation of the VTS support about the VTS axis. Positions of the gate between the first and second angles are stowed positions. The VTS support remains in a fixed position during rotation of the gate between the second angle and a third angle. Positions of the gate between the second angle and the third angle are positions where the gate redirects a jet of water expelled from the steering nozzle when the engine is in operation.

In an additional aspect, the VTS support is a VTS ring encircling at least a portion of the steering nozzle. The steering nozzle is rotationally mounted to the VTS ring about the steering axis at a top and at a bottom of the VTS ring.

In a further aspect, the gate axis is offset from the VTS axis.

In an additional aspect, the gate axis is vertically lower than the VTS axis.

In a further aspect, a left side bracket is connected to a left side of the venturi and a right side bracket is connected to a right side of the venturi. The VTS support is rotationally mounted to the left and right side brackets about the VTS axis. The gate is rotationally mounted to the left and right side brackets about the gate axis. The gate axis is offset from the VTS axis.

In an additional aspect, the left side bracket is disposed between the gate and the VTS support, and the right side bracket is disposed between the gate and the VTS support. The VTS support is disposed between the left and right side brackets.

In a further aspect, at least one of the left and right side brackets includes at least one stopper. The at least one stopper abuts at least one of the VTS support and the gate to limit rotation of the at least one of the VTS support and the gate in a least one direction.

In an additional aspect, the at least one abutment surface is at least one first abutment surface. The watercraft also has at least one second abutment surface disposed on the other one of the VTS support and the gate. The at least one follower abuts the at least one first abutment surface when the gate rotates in a first direction and the at least one follower abuts the at least one second abutment surface when the gate rotates in a second direction opposite the first direction. Rotation of the gate about the gate axis in the first direction results in the displacement of the at least one follower along the at least one first abutment surface. The displacement of the at least one follower along the at least one first abutment surface results in rotation of the VTS support about the VTS axis in the first direction. Rotation of the gate about the gate axis in the second direction results in the displacement of the at least one follower along the at least one second abutment surface. The displacement of the at least one follower along the at least one second abutment surface results in rotation of the VTS support about the VTS axis in the second direction.

In a further aspect, the at least one first and second abutment surfaces define a channel. The at least one follower is received in the at least one channel.

In an additional aspect, the actuator is a linear actuator.

In a further aspect, the gate includes: a gate body having an inner surface and an outer surface; and at least one deflector connected to the outer surface of the gate body.

In another aspect, a variable trim system and gate assembly for a watercraft jet propulsion system has a variable trim system (VTS) support adapted to be rotationally mounted to a venturi of the jet propulsion system about a generally laterally and horizontally extending VTS axis, the VTS support being adapted to rotationally mount a steering nozzle to the VTS support about a steering axis, the steering axis being generally perpendicular to the VTS axis, and a gate operatively connected to the VTS support about a generally laterally and horizontally extending gate axis such that rotation of the gate about the gate axis results in rotation of the VTS support about the VTS axis, the gate being adapted to be connected to an actuator such that the gate is operatively connected between the actuator and the VTS support.

In an additional aspect, the variable trim system and gate assembly has the venturi. The VTS support is rotationally mounted to the venturi about the VTS axis.

In a further aspect, at least one follower extends from one of the VTS support and the gate. At least one abutment surface is disposed on an other one of the VTS support and the gate. The at least one follower abuts the at least one abutment surface through at least a range of rotation of the gate. Rotation of the gate about the gate axis results in a displacement of the at least one follower along the at least one abutment surface. The displacement of the at least one follower along the at least one abutment surface results in rotation of the VTS support about the VTS axis.

In an additional aspect, the at least one abutment surface is disposed on the gate and the at least one follower is disposed on the VTS support.

In a further aspect, the at least one abutment surface is at least one first abutment surface. The variable trim system and gate assembly also has at least one second abutment surface disposed on the other one of the VTS support and the gate. The at least one second abutment surface extends from the at least one first abutment surface. Rotation of the gate about the gate axis through a first range of angles results in the displacement of the at least one follower along the at least one first abutment surface. The displacement of the at least one follower along the at least one first abutment surface results in rotation of the VTS support about the VTS axis. Rotation of the gate about the gate axis through a second range of angles results in a displacement of the at least one follower along the at least one second abutment surface. The displacement of the at least one follower along the at least one second abutment surface maintaining the VTS support in position.

In an additional aspect, the at least one abutment surface is at least one first abutment surface. The variable trim system and gate assembly also has at least one second abutment surface disposed on the other one of the VTS support and the gate. The at least one follower abuts the at least one first abutment surface when the gate rotates in a first direction and the at least one follower abuts the at least one second abutment surface when the gate rotates in a second direction opposite the first direction. Rotation of the gate about the gate axis in the first direction results in the displacement of the at least one follower along the at least one first abutment surface. The displacement of the at least one follower along the at least one first abutment surface results in rotation of the VTS support about the VTS axis in the first direction. Rotation of the gate about the gate axis in the second direction results in the displacement of the at least one follower along the at least one second abutment surface. The displacement of the at least one follower along the at least one second abutment surface results in rotation of the VTS support about the VTS axis in the second direction.

In a further aspect, the gate axis is offset from the VTS axis.

In an additional aspect, rotation of the gate between a first angle and a second angle causes a rotation of the VTS support about the VTS axis. Positions of the gate between the first and second angles are stowed positions. The VTS support remains in a fixed position during rotation of the gate between the second angle and a third angle. Positions of the gate between the second angle and the third angle are positions where the gate redirects a jet of water expelled from the steering nozzle when the watercraft jet propulsion system is in operation.

In a further aspect, the VTS support has a first pair of apertures for rotationally mounting the VTS support relative to the venturi about the VTS axis and a second pair of apertures adapted to rotationally mount the steering nozzle to the VTS support about the steering axis.

For purposes of this application, terms related to spatial orientation such as forwardly, rearwardly, left, and right, are as they would normally be understood by a driver of the watercraft sitting thereon in a normal driving position. Terms related to spatial orientation when referring to the jet propulsion system alone should be understood as they would normally be understood when the jet propulsion system is installed on a watercraft. The explanations provided above regarding the above terms take precedence over explanations of these terms that may be found in any one of the documents incorporated herein by reference.

Embodiments of the present invention each have at least one of the above-mentioned object and/or aspects, but do not necessarily have all of them. It should be understood that some aspects of the present invention that have resulted from attempting to attain the above-mentioned object may not satisfy this object and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

The embodiments of the present watercraft jet propulsion system will be described with respect to a personal watercraft and a jet boat. However, it is contemplated that embodiments of the present watercraft jet propulsion system could be used with other types of watercraft.

The general construction of a personal watercraft 10 will be described with respect to FIGS. 1 to 5. The following description relates to one way of manufacturing a personal watercraft. Those of ordinary skill in the watercraft art should recognize that there are other known ways of manufacturing and designing personal watercraft and that these are contemplated.

Figure 1:
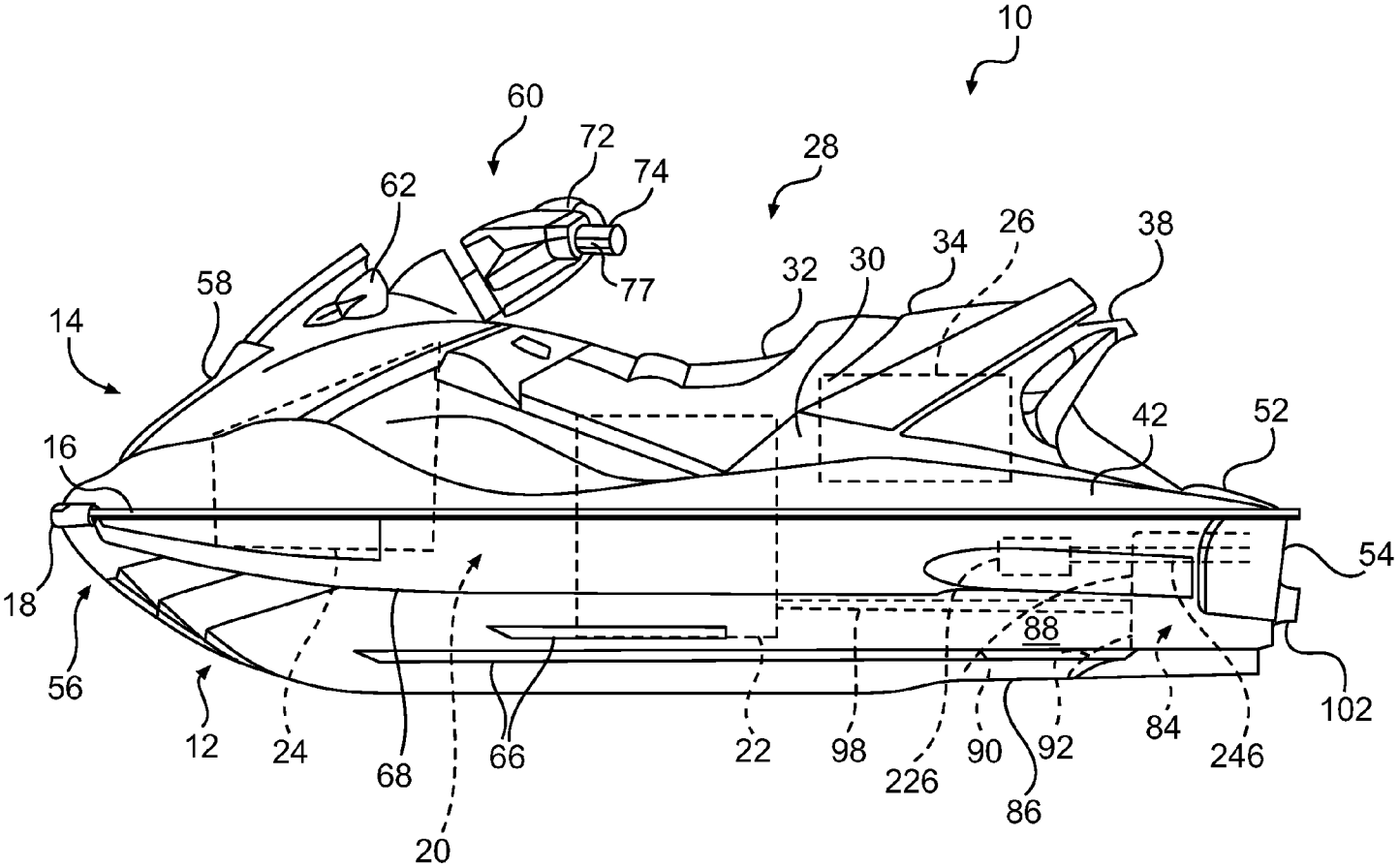
FIG. 1 illustrates a left side elevation view of a personal watercraft.

The personal watercraft 10 of FIG. 1 includes a hull 12 and a deck 14. The hull 12 buoyantly supports the watercraft 10 in the water. The deck 14 is designed to accommodate a rider and, in some watercraft, one or more passengers. The hull 12 and deck 14 are joined together at a seam 16 that joins the parts in a sealing relationship. The seam 16 comprises a bond line formed by an adhesive. Other known joining methods could be used to sealingly engage the hull 12 and deck 14 together, including but not limited to thermal fusion, molding or fasteners such as rivets or screws. A bumper 18 generally covers the seam 16, which helps to prevent damage to the outer surface of the watercraft 10 when the watercraft 10 is docked, for example. The bumper 18 can extend around the bow 56, as shown, or around any portion or the entire seam 16.

The space between the hull 12 and the deck 14 forms a volume commonly referred to as the engine compartment 20. The engine compartment 20 accommodates an engine 22 (shown schematically in FIG. 1), as well as a muffler, gas tank, electrical system (battery, electronic control unit, etc.), air box, storage bins 24, 26, and other elements required or desirable in the watercraft 10.

Figure 2:
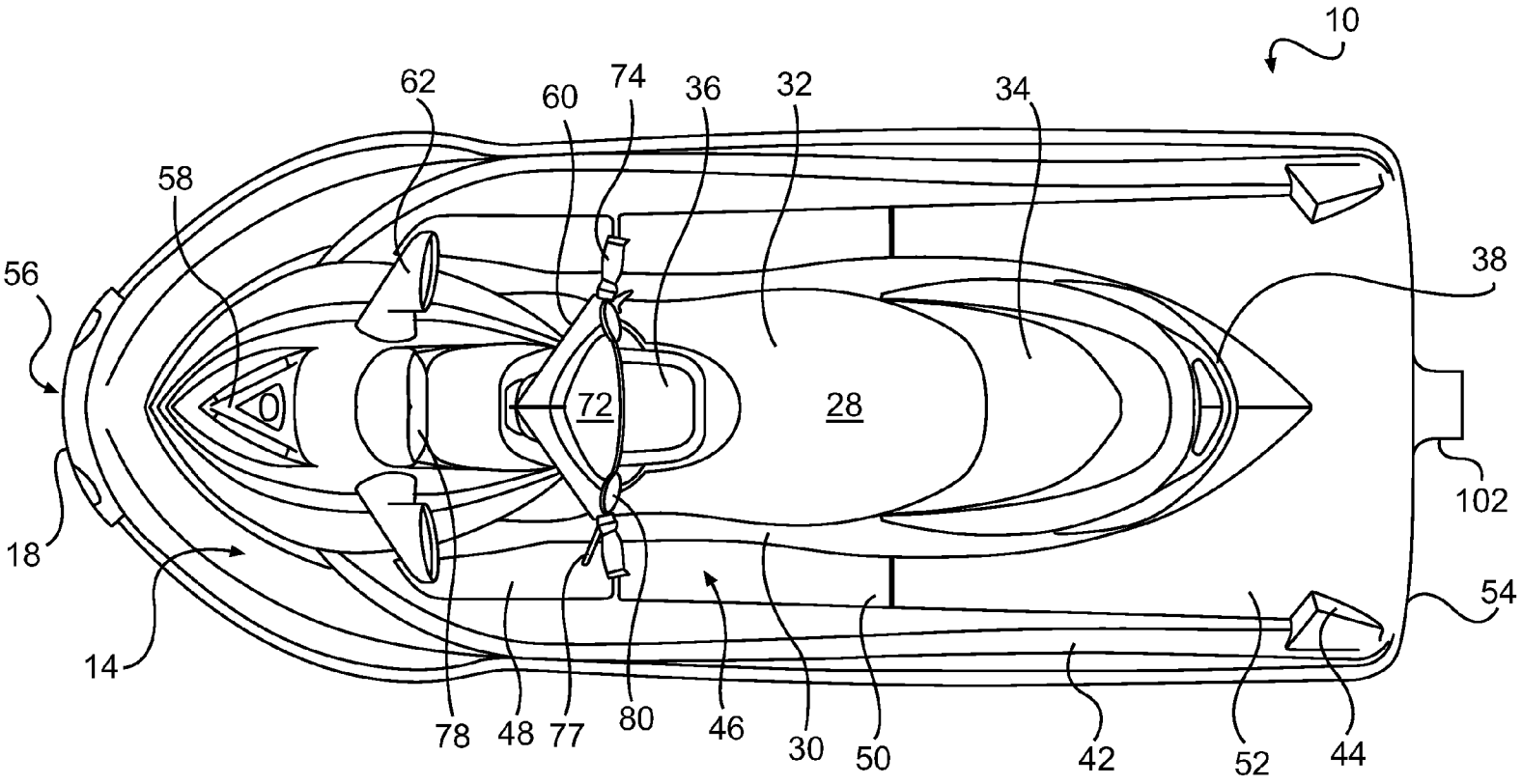
FIG. 2 is a top plan view of the watercraft of FIG. 1.

As seen in FIGS. 1 and 2, the deck 14 has a centrally positioned straddle-type seat 28 positioned on top of a pedestal 30 to accommodate a driver and a passenger in a straddling position. The seat 28 includes a first, front seat portion 32 and a second, rear, raised seat portion 34. The first and second seat portions 32, 34 are removably attached to the pedestal 30 by a hook and tongue assembly (not shown) at the front of each seat and by a latch assembly (not shown) at the rear of each seat, or by any other known attachment mechanism. The seat portions 32, 34 can be individually tilted or removed completely. One of the seat portions 32, 34 covers an engine access opening (in this case above engine 22) defined by a top portion of the pedestal 30 to provide access to the engine 22 (FIG. 1). The other seat portion (in this case portion 34) covers a removable storage box 26 (FIG. 1). It is contemplated that the seat 28 could be a single seat element. It is also contemplated that the seat 28 could be sized to accommodate only a driver or a driver and more than one passenger. A "glove compartment" or small storage box 36 is provided in front of the seat 28.

A grab handle 38 is provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

Figure 4:
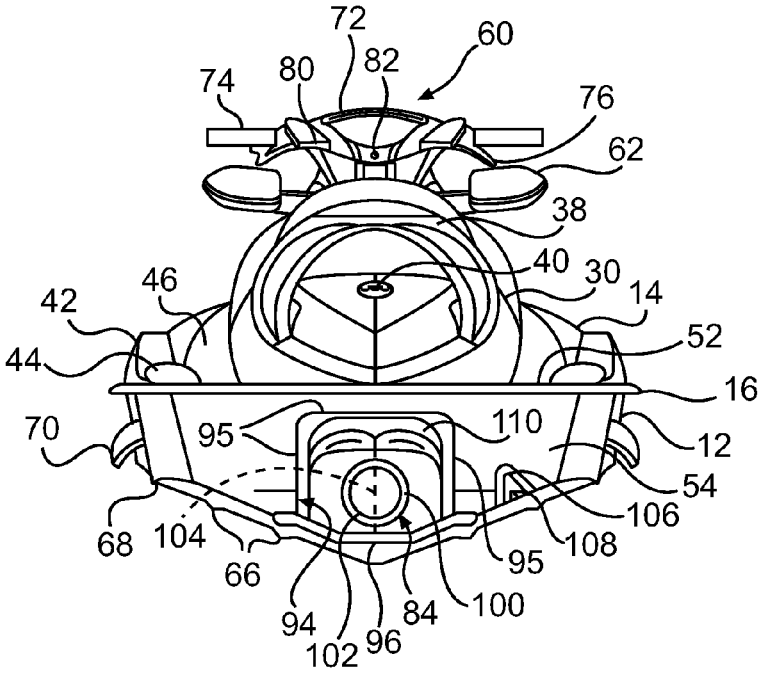
FIG. 4 is a rear elevation view of the watercraft of FIG. 1.

As best seen in FIGS. 2 and 4, the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the riders' feet, and also provide buoyancy when turning the watercraft 10, since personal watercraft roll slightly when turning. Towards the rear of the watercraft 10, the gunnels 42 extend inwardly to act as heel rests 44. Heel rests 44 allow a passenger riding the watercraft 10 facing towards the rear, to spot a water-skier for example, to place his or her heels on the heel rests 44, thereby providing a more stable riding position. Heel rests 44 could also be formed separate from the gunnels 42.

Located on both sides of the watercraft 10, between the pedestal 30 and the gunnels 42 are the footrests 46. The footrests 46 are designed to accommodate a rider's feet in various riding positions. To this effect, the footrests 46 each have a forward portion 48 angled such that the front portion of the forward portion 48 (toward the bow 56 of the watercraft 10) is higher, relative to a horizontal reference point, than the rear portion of the forward portion 48. The remaining portions of the footrests 46 are generally horizontal. Of course, any contour conducive to a comfortable rest for the riders' feet could be used. The footrests 46 are covered by carpeting 50 made of a rubber-type material, for example, to provide additional comfort and traction for the feet of the riders.

A reboarding platform 52 is provided at the rear of the watercraft 10 on the deck 14 to allow the driver or a passenger to easily reboard the watercraft 10 from the water. Carpeting or some other suitable covering covers the reboarding platform 52. A retractable ladder (not shown) may be affixed to the transom 54 to facilitate boarding the watercraft 10 from the water onto the reboarding platform 52.

Figure 3:
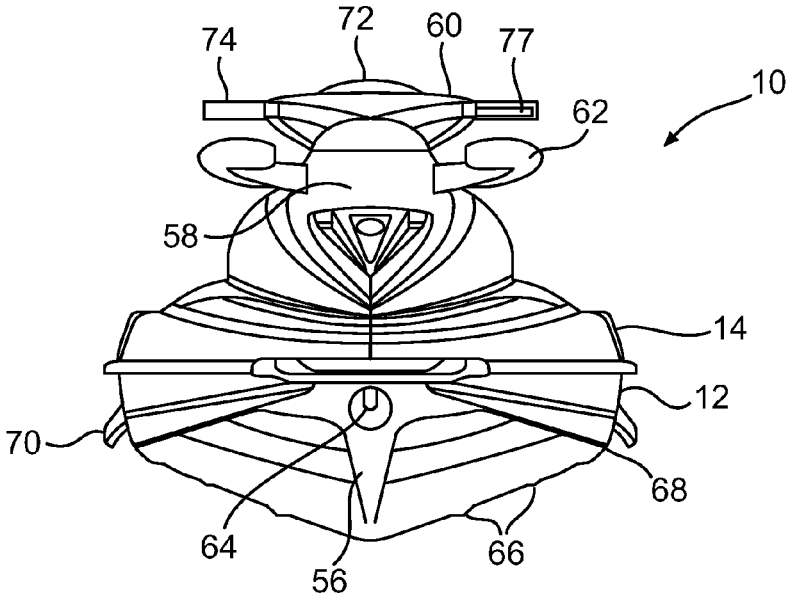
FIG. 3 is a front elevation view of the watercraft of FIG. 1.

Referring to the bow 56 of the watercraft 10, as seen in FIGS. 2 and 3, the watercraft 10 is provided with a hood 58 located forwardly of the seat 28 and a steering assembly including a helm assembly 60. A hinge (not shown) is attached between a forward portion of the hood 58 and the deck 14 to allow the hood 58 to move to an open position to provide access to the front storage bin 24 (FIG. 1). A latch (not shown) located at a rearward portion of the hood 58 locks the hood 58 into a closed position. When in the closed position, the hood 58 prevents water from entering the front storage bin 24. Rearview mirrors 62 are positioned on either side of the hood 58 to allow the rider to see behind the watercraft 10. A hook 64 is located at the bow 56 of the watercraft 10. The hook 64 is used to attach the watercraft 10 to a dock when the watercraft 10 is not in use or to attach to a winch when loading the watercraft 10 on a trailer for instance.

Figure 5:
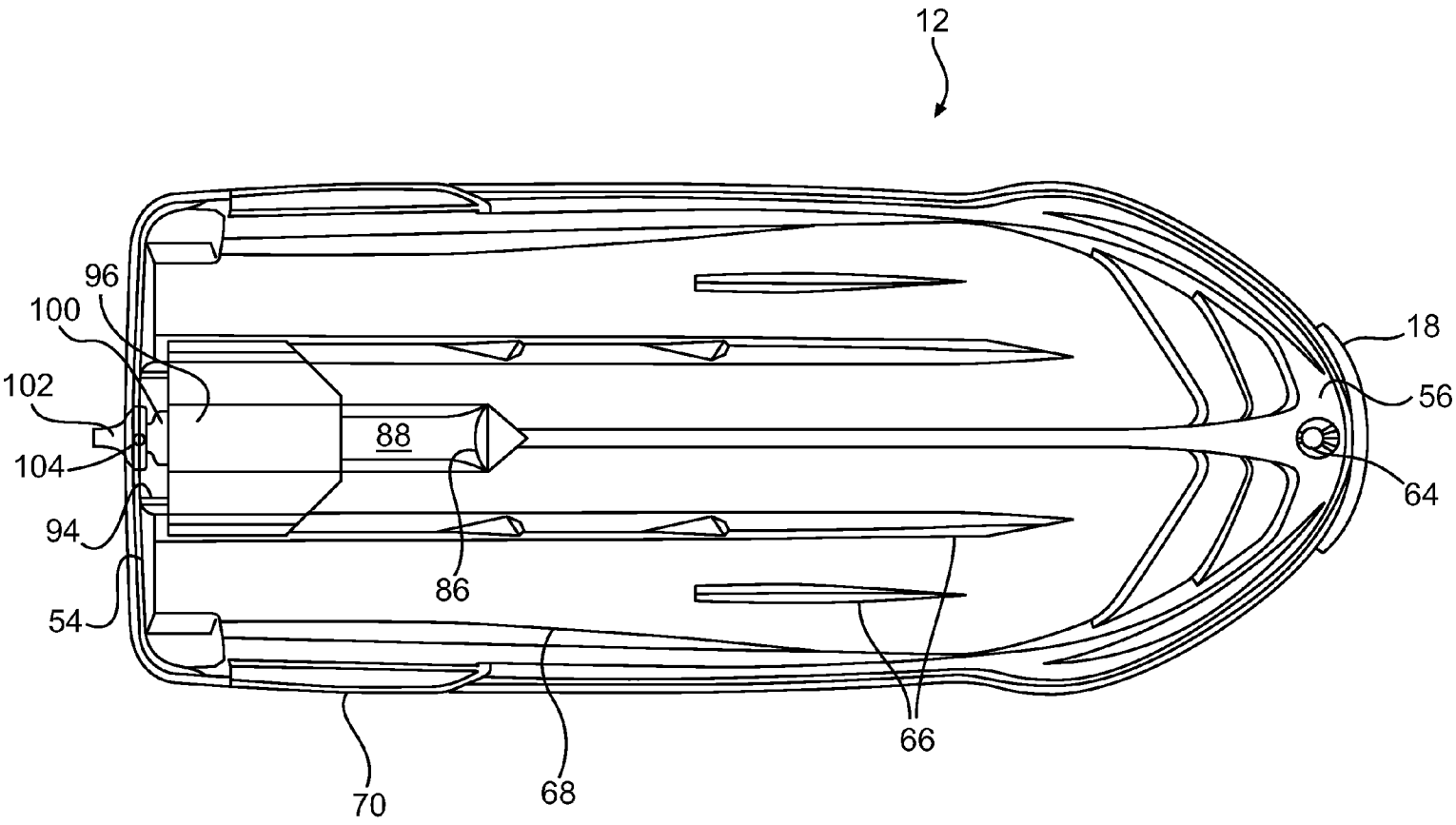
FIG. 5 is a bottom plan view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 have an arcuate undersurface that gives the watercraft 10 both lift while in motion and improved turning characteristics. The sponsons 70 are fixed to the surface of the hull 12 and can be attached to the hull 12 by fasteners or molded therewith. It is contemplated that the position of the sponsons 70 could be adjusted with respect to the hull 12 to change the handling characteristics of the watercraft 10 and to accommodate different riding conditions.

As best seen in FIGS. 3 and 4, the helm assembly 60 is positioned forwardly of the seat 28. The helm assembly 60 has a central helm portion 72 that may be padded, and a pair of steering handles 74, also referred to as a handlebar. One of the steering handles 74 is provided with a throttle operator 76, which allows the rider to control the engine 22, and therefore the speed of the watercraft 10. The throttle operator 76 can be in the form of, but not limited to, a thumb-actuated throttle lever (as shown), a finger-actuated throttle lever, or a twist grip. The throttle operator 76 is movable between an idle position and multiple actuated positions. The throttle operator 76 is biased towards the idle position, such that when the driver of the watercraft 10 lets go of the throttle operator 76, it moves to the idle position. The other of the steering handles 74 is provided with a lever 77 used by the driver to control the jet propulsion system 84 as described in greater detail below. It is contemplated that the lever 77 could be omitted. In such an embodiment, the lever 77 could be replaced by another type of input to the jet propulsion system 84, such as buttons or switches, or the aspects of the jet propulsion system 84 that would have been controlled by the lever 77 could be controlled automatically.

As seen in FIG. 2, a display area or cluster 78 is located forwardly of the helm assembly 60. The display cluster 78 can be of any conventional display type, including, but not limited to, a liquid crystal display (LCD), dials or LED (light emitting diodes). The central helm portion 72 has various buttons 80, which could alternatively be in the form of levers or switches that allow the driver to modify the display data or mode (speed, engine rpm, time . . . ) on the display cluster 78. It is contemplated that in some embodiments, the buttons 80 may also be used by the driver to control the jet propulsion system 84 as described in greater detail below.

The helm assembly 60 also has a key receiving post 82 located near a center of the central helm portion 72. The key receiving post 82 is adapted to receive a key (not shown) that starts the watercraft 10. The key is typically attached to a safety lanyard (not shown). It should be noted that the key receiving post 82 may be placed in any suitable location on the watercraft 10.

Returning to FIGS. 1 and 5, the watercraft 10 is generally propelled by a jet propulsion system 84. The jet propulsion system 84 pressurizes water to create thrust. The water is first scooped from under the hull 12 through an inlet 86, which has a grate (not shown in detail). The inlet grate prevents large rocks, weeds, and other debris from entering the jet propulsion system 84, which may damage the jet propulsion system 84 or negatively affect performance. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

From the intake ramp 88, water enters the jet propulsion system 84. As seen in FIG. 4, the jet propulsion system 84 is located in a formation in the hull 12, referred to as the tunnel 94. The tunnel 94 is defined at the front, sides, and top by walls 95 formed by the hull 12 and is open at the transom 54. The bottom of the tunnel 94 is closed by a ride plate 96. The ride plate 96 creates a surface on which the watercraft 10 rides or planes at high speeds.

Figure 8:
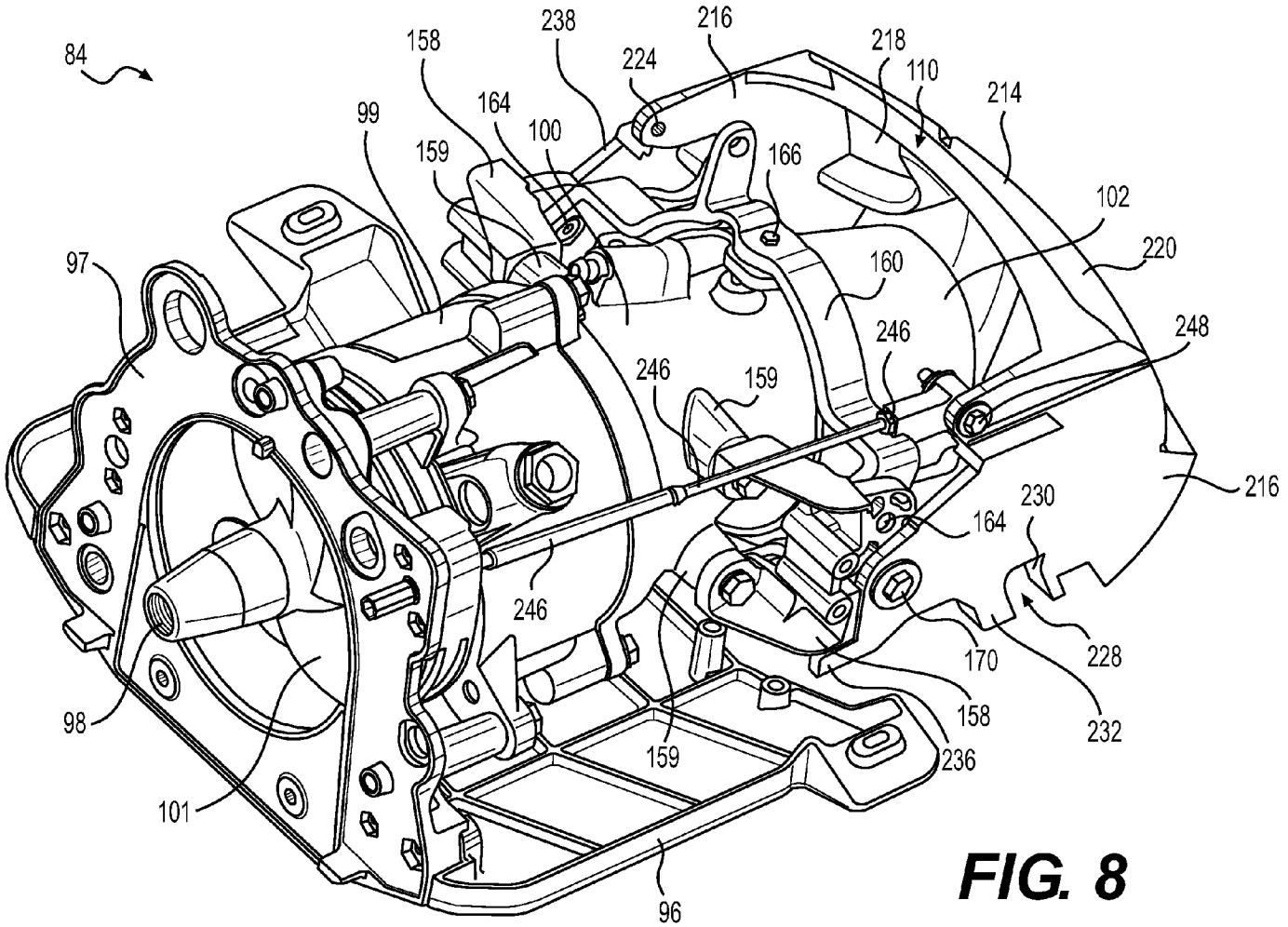
FIG. 8 is a perspective view, taken from a front, left side, of a jet propulsion system with a reverse gate in a lowered position.

The jet propulsion system 84 includes a jet pump 99. The forward end of the jet pump 99 is connected to the front wall 95 of the tunnel 94 via a pump mounting plate 97 (FIG. 8). The jet pump 99 includes an impeller 101 (FIG. 8) and a stator (not shown). The impeller 101 is coupled to the engine 22 by one or more shafts 98, such as a driveshaft and an impeller shaft. The rotation of the impeller 101 pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump 99, it goes through a venturi 100 that is connected to the rearward end of the jet pump 99. The venturi's exit diameter is smaller than its entrance diameter. As a result the water is accelerated further, thereby providing more thrust. A steering nozzle 102 is rotationally mounted relative to the venturi 100, as described in greater detail below, so as to pivot about a steering axis 104 (FIG. 4).

The steering nozzle 102 is operatively connected to the helm assembly 60 via a push-pull cable (not shown) such that when the helm assembly 60 is turned, the steering nozzle 102 pivots about the steering axis 104. This movement redirects the pressurized water coming from the venturi 100, so as to redirect the thrust and steer the watercraft 10 in the desired direction.

The jet propulsion system 84 is provided with a gate 110 that is movable between a plurality of positions. In the illustrated embodiment, the gate 110 is a reverse gate 110 that is movable between a plurality of stowed positions where it does not interfere with a jet of water being expelled by the steering nozzle 102 and a plurality of positions where it redirects the jet of water being expelled by the steering nozzle 102 as described in greater detail below. Aspects of the reverse gate 110 will be described in greater detail below. The reverse gate 110 is used to cause the watercraft 10 to move in a reverse direction by redirecting the jet of water being expelled by the steering nozzle 102 toward a front of the watercraft 10. In some embodiments, the reverse gate 110 can also be used to cause the forwardly moving watercraft 10 to decelerate by redirecting the jet of water from the steering nozzle 102 in the same manner and/or by creating drag in the water. It is contemplated that the reverse gate 110 could be replaced by another type of gate that is not shaped to redirect the jet of water being expelled by the steering nozzle 102 toward a front of the watercraft 10, and thus does not allow the watercraft 10 to move in the reverse direction, but that is suitably shaped to decelerate the watercraft 10 when lowered.

When the watercraft 10 is moving, its speed is measured by a speed sensor 106 attached to the transom 54 of the watercraft 10. The speed sensor 106 has a paddle wheel 108 that is turned by the water flowing past the hull 12. In operation, as the watercraft 10 goes faster, the paddle wheel 108 turns faster in correspondence. An electronic control unit (ECU) (not shown) connected to the speed sensor 106 converts the rotational speed of the paddle wheel 108 to the speed of the watercraft 10 in kilometers or miles per hour, depending on the driver's preference. The speed sensor 106 may also be placed in the ride plate 96 or at any other suitable position. Other types of speed sensors, such as, but not limited to, pitot tubes, and processing units could be used. Alternatively, a global positioning system (GPS) unit could be used to determine the speed of the watercraft 10 by calculating the change in position of the watercraft 10 over a period of time based on information obtained from the GPS unit.

Figure 6:
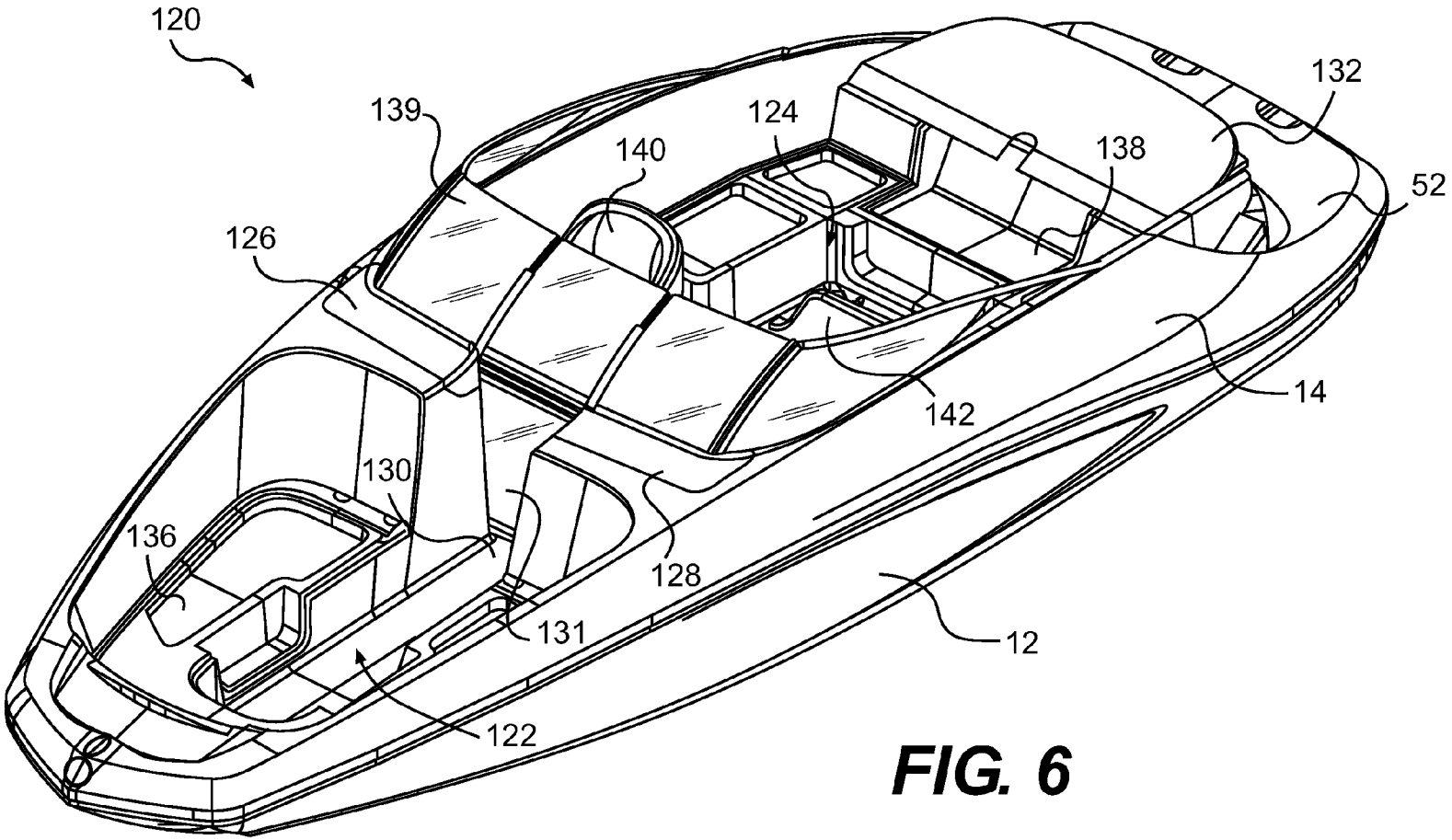
FIG. 6 is a perspective view, taken from a front, left side, of a jet boat.
Figure 7:
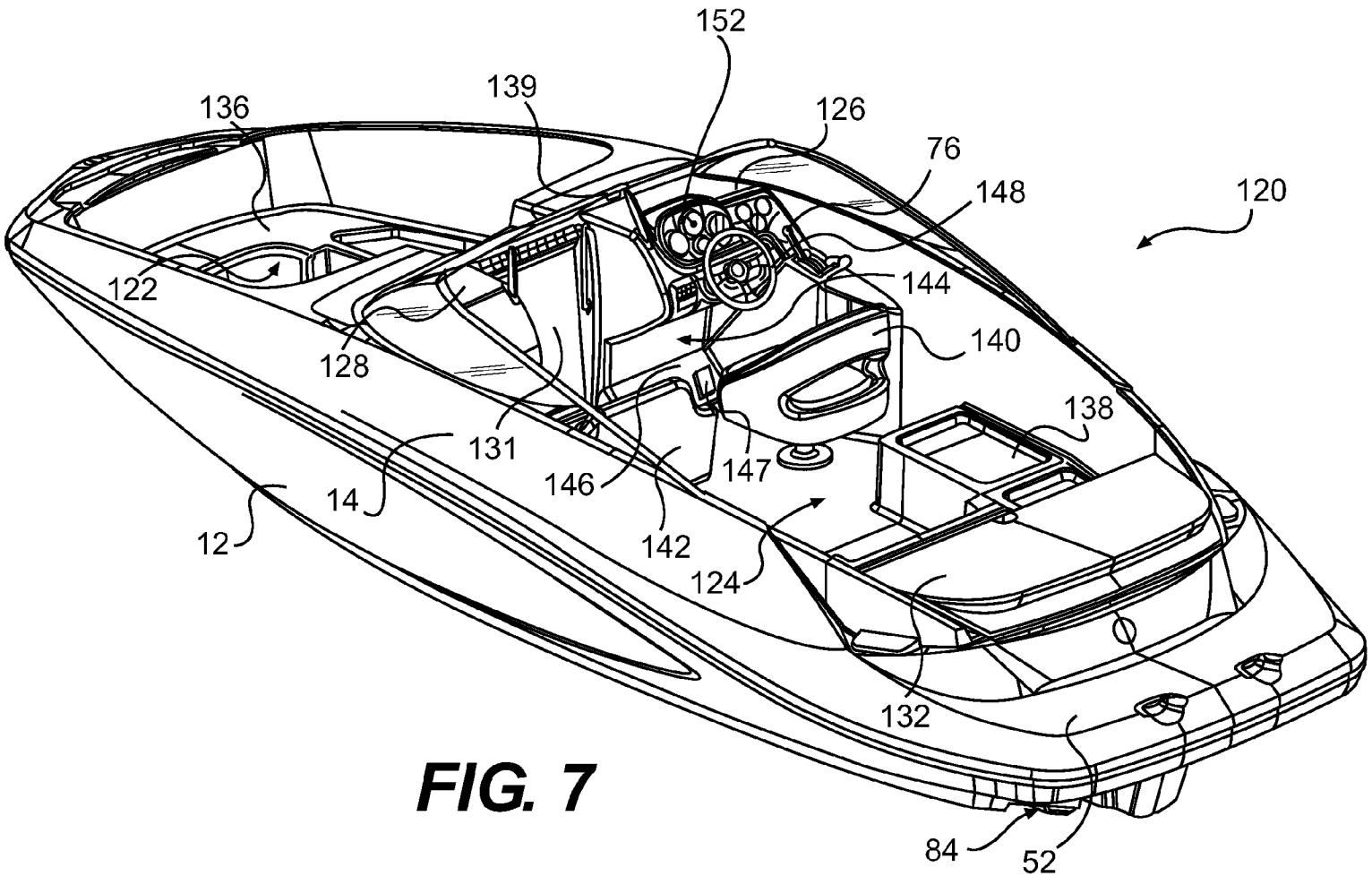
FIG. 7 is a perspective view, taken from a rear, left side, of the jet boat of FIG. 6.

The general construction of a jet boat 120 will now be described with respect to FIGS. 6 and 7. The following description relates to one way of manufacturing a jet boat. Those of ordinary skill in the jet boat art should recognize that there are other known ways of manufacturing and designing watercraft such as jet boats and that these are contemplated.

For simplicity, the components of the jet boat 120 which are similar in nature to the components of the personal watercraft 10 described above will be given the same reference numerals. It should be understood that their specific construction may vary however.

The jet boat 120 has a hull 12 and a deck 14 supported by the hull 12. The deck 14 has a forward passenger area 122 and a rearward passenger area 124. A right console 126 and a left console 128 are disposed on either side of the deck 14 between the two passenger areas 122, 124. A passageway 130 disposed between the two consoles 126, 128 allows for communication between the two passenger areas 122, 124. A door 131 is used to selectively open and close the passageway 130. A pair of engines (not shown) is located between the hull 12 and the deck 14 at the back of the boat 120. The pair of engines powers a pair of jet propulsion systems 84 (only a left one of which is shown). Each jet propulsion system 84 is of similar construction as the jet propulsion system 84 of the personal watercraft 10 described above, and in greater detail below, and will therefore not be described in detail here. It is contemplated that the boat 120 could have only one engine powering both jet propulsion systems 84. It is also contemplated that the boat 120 could have only one engine powering only one jet propulsion system 84. The engines are accessible through an engine cover 132 located behind the rearward passenger area 124. The engine cover 132 can also be used as a sundeck for a passenger of the boat 120 to sunbathe on while the boat 120 is not in motion. A reboarding platform 52 is located at the back of the deck 14 for passengers to easily reboard the boat 120 from the water.

The forward passenger area 122 has a C-shaped seating area 136 for passengers to sit on. The rearward passenger area 124 also has a C-shaped seating area 138 at the back thereof. A driver seat 140 facing the right console 126 and a passenger seat 142 facing the left console 124 are also disposed in the rearward passenger area 124. It is contemplated that the driver and passenger seats 140, 142 could swivel so that the driver and passenger occupying these seats can socialize with passengers occupying the C-shaped seating area 138. A windshield 139 is provided at least partially on the left and right consoles 124, 126 and forwardly of the rearward passenger area 124 to shield the passengers sitting in that area from the wind when the boat 120 is in movement. The right and left consoles 126, 128 extend inwardly from their respective side of the boat 120. At least a portion of each of the right and the left consoles 126, 128 is integrally formed with the deck 14. The right console 126 has a recess 144 formed on the lower portion of the back thereof to accommodate the feet of the driver sitting in the driver seat 140 and an angled portion of the right console 126 acts as a footrest 146. A foot pedal 147 is provided on the footrest 146 which, in some embodiments, may be used to control the jet propulsion system 84 as described in greater detail below. The left console 128 has a similar recess (not shown) to accommodate the feet of the passenger sitting in the passenger seat 142. The right console 126 accommodates all of the elements necessary for the driver to operate the boat 120. These include, but are not limited to, a steering assembly including a steering wheel 148, a throttle operator 76 in the form of a throttle lever, and an instrument panel 152. The instrument panel 152 has various dials indicating the watercraft speed, engine speed, fuel and oil level, and engine temperature. The speed of the boat 120 is measured by a speed sensor (not shown) which can be in the form of the speed sensor 106 described above with respect to the personal watercraft 10 or a GPS unit or any other type of speed sensor which could be used for marine applications. It is contemplated that the elements attached to the right console 126 could be different than those mentioned above. The left console 128 incorporates a storage compartment (not shown) which is accessible to the passenger sitting the passenger seat 142.

Turning now to FIGS. 8 to 18C a first embodiment of the jet propulsion system 84 will be described. In the description provided above, the jet propulsion system 84 is disposed in a tunnel 94 of the watercraft 10. However, it is contemplated that the jet propulsion system 84 could be mounted directly to the transom 54.

Figure 10:
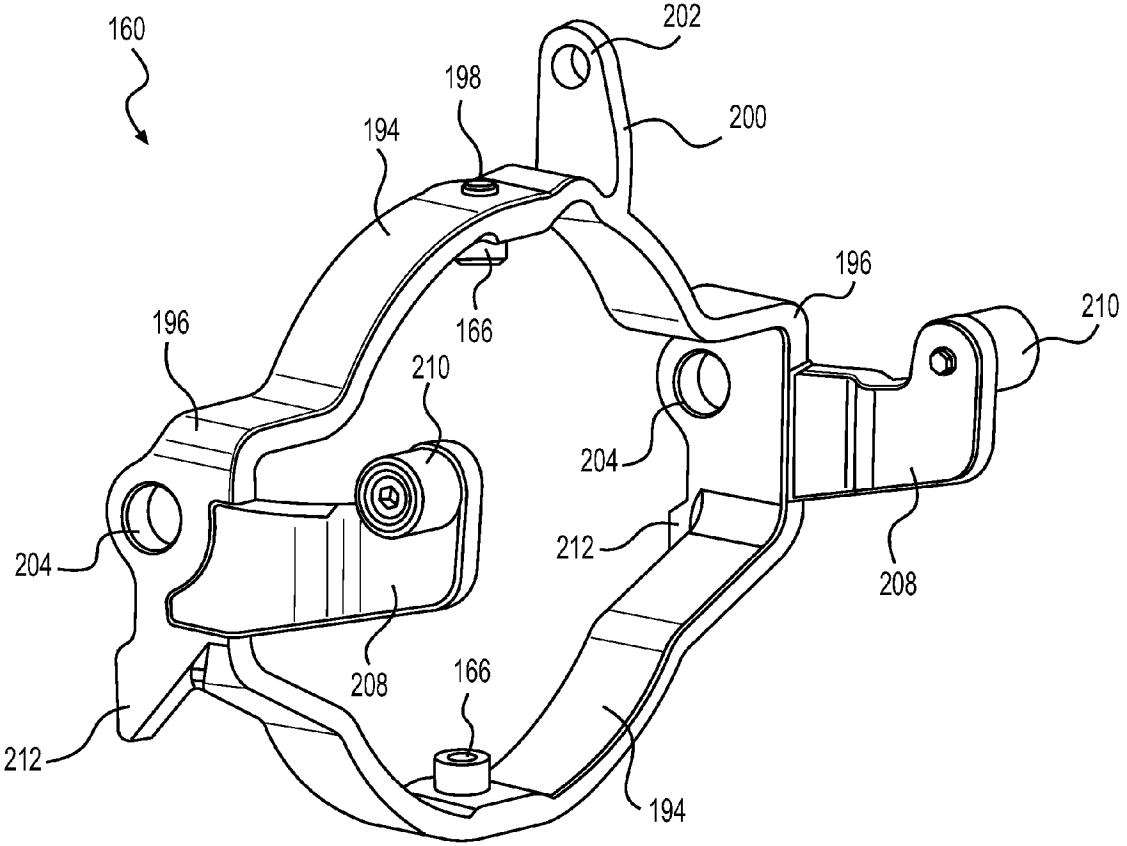
FIG. 10 is a perspective view taken from a rear, left side of a variable trim system (VTS) ring of the jet propulsion of FIG. 8.
Figure 12B:
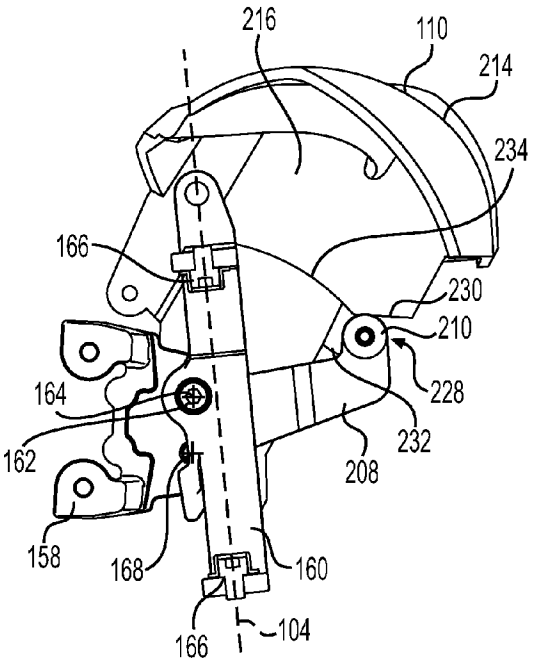
FIG. 12B is a cross-sectional view of the jet propulsion of FIG. 8 in the position shown in FIG. 12A taken through line 12B-12B of FIG. 12C and with a jet pump, a venturi and a steering nozzle removed.
Figure 12A:
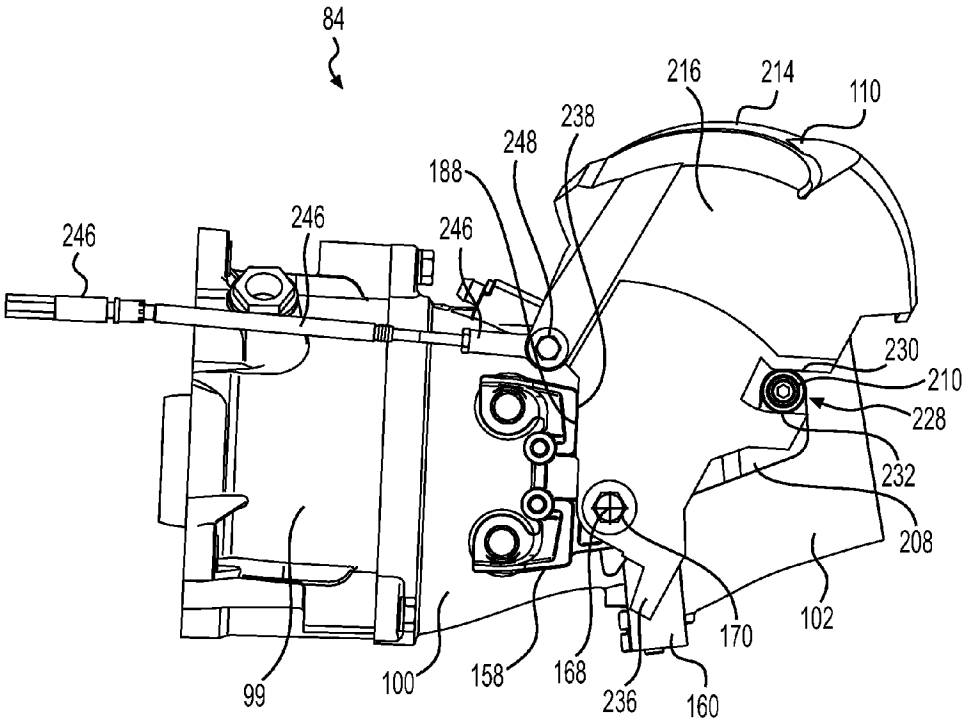
FIG. 12A is a left side elevation view of the jet propulsion system of FIG. 8 with the VTS in an up position and the reverse gate in a stowed position.
Figure 12C:
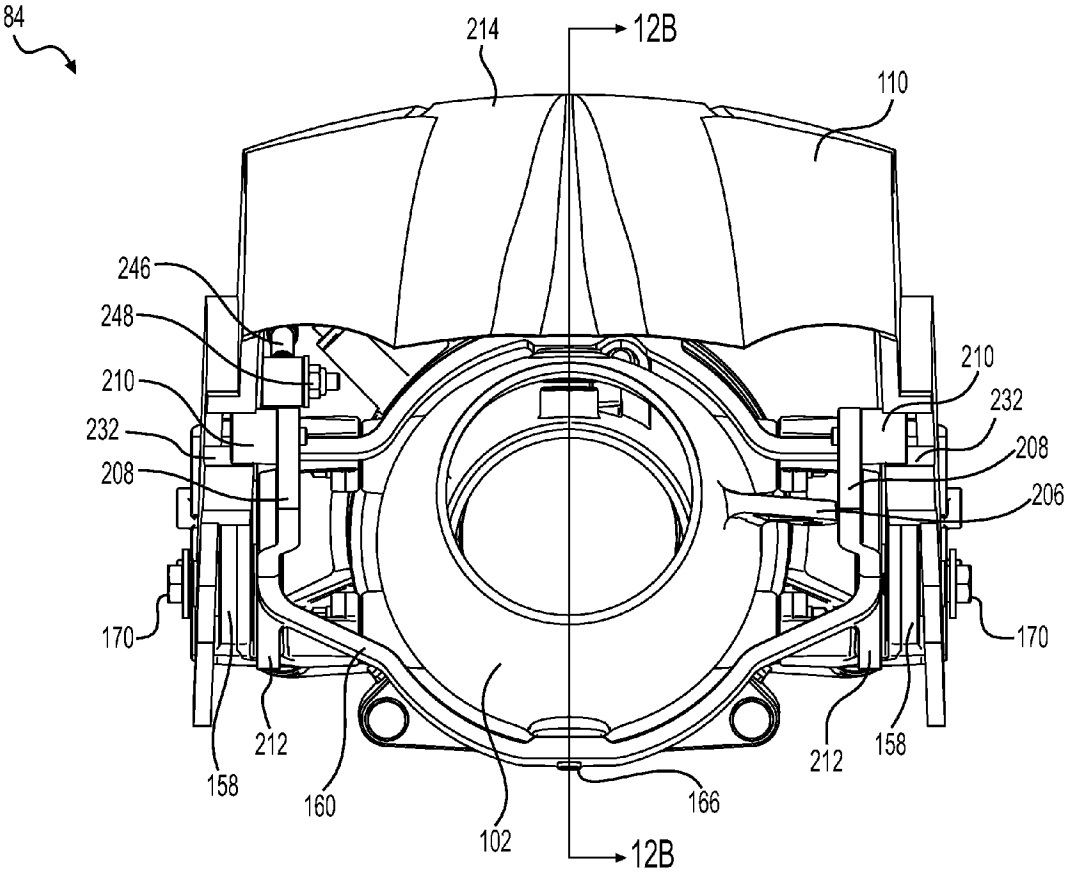
FIG. 12C is a rear side elevation view of the jet propulsion system of FIG. 8 in the position shown in FIG. 12A.
Figure 17B:
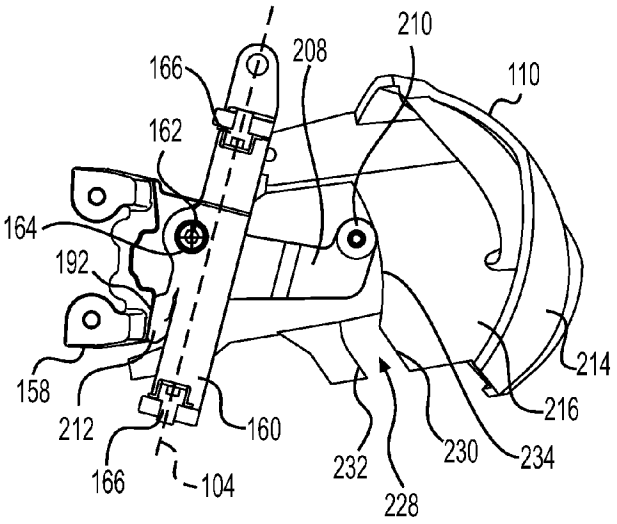
FIG. 17B is a cross-sectional view of the jet propulsion of FIG. 8 in the position shown in FIG. 17A taken through line 17B-17B of FIG. 17C and with the jet pump, the venturi and the steering nozzle removed.
Figure 17A:
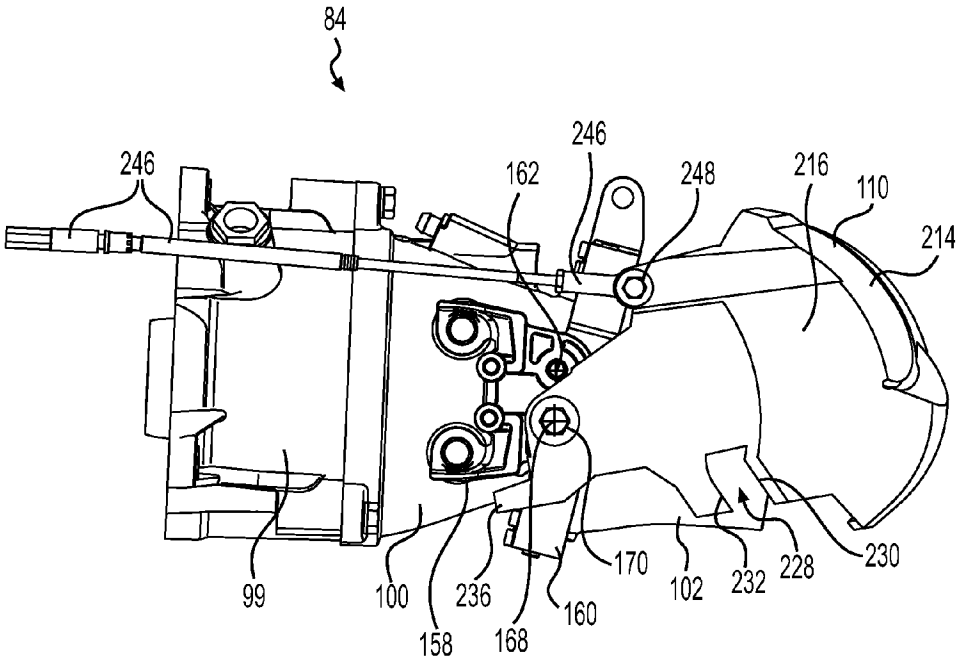
FIG. 17A is a left side elevation view of the jet propulsion system of FIG. 8 with the VTS in a fully lowered position and the reverse gate in another lowered position.
Figure 17C:
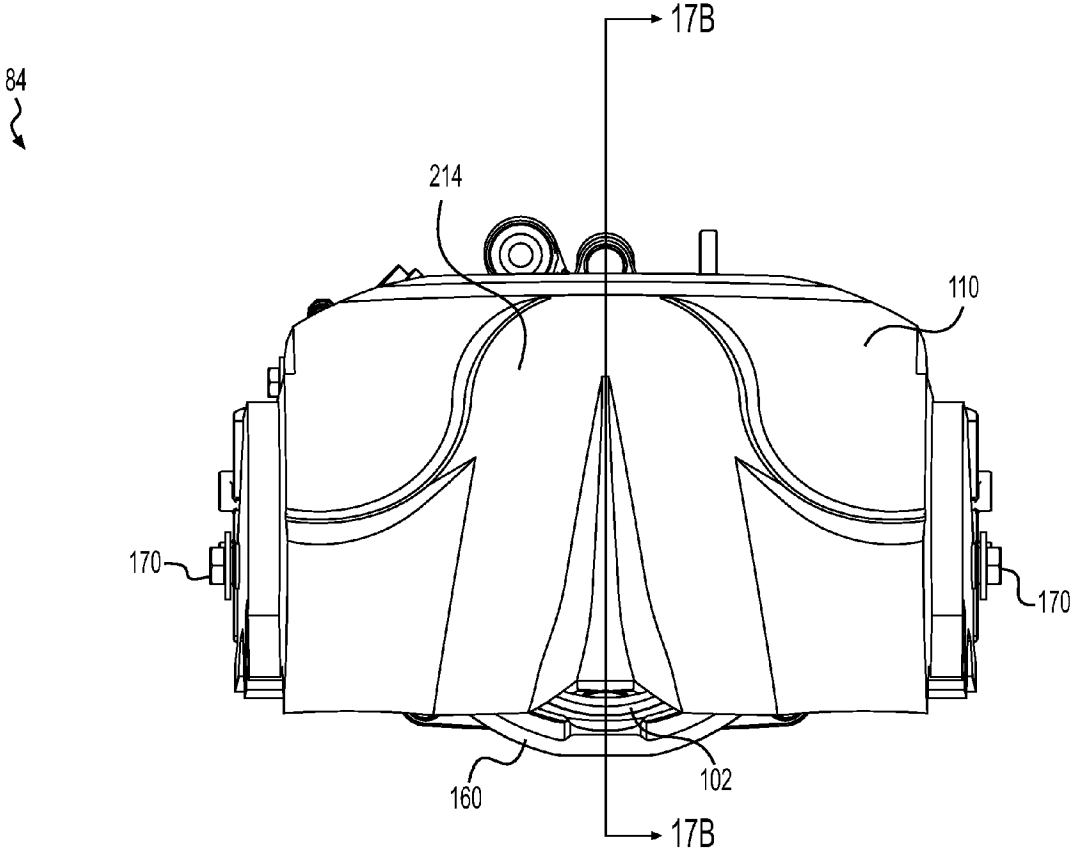
FIG. 17C is a rear side elevation view of the jet propulsion system of FIG. 8 in the position shown in FIG. 17A.

As previously mentioned, the jet propulsion assembly 84 includes a jet pump 99, a venturi 100, a steering nozzle 102, and a reverse gate 110. Left and right side brackets 158 are fastened to bosses 159 formed on the left and right sides of the venturi 100 respectively. A variable trim system (VTS) support 160 is rotationally mounted to the left and right side brackets 158 about a VTS axis 162 (FIG. 12B). The VTS axis 162 extends generally laterally and horizontally. As can been seen in FIG. 12C for example, the VTS support 160 is disposed between the brackets 158. Threaded fasteners 164 are used to connect the VTS support 160 to the side brackets 158. It is contemplated that the VTS support 160 could be rotationally mounted about the VTS axis 162 directly to the jet pump 99 or the venturi 100 so as to be rotationally mounted relative to the venturi 100. It is also contemplated that the VTS support 160 could be rotationally mounted about the VTS axis 162 to the side walls 95 of the tunnel 94 directly or through suitable brackets so as to be rotationally mounted relative to the venturi 100. As best seen in FIG. 10, the VTS support 160 is in the shape of a ring and is therefore a VTS ring, but other shapes are contemplated. The VTS support 160 encircles the forward portion of the steering nozzle 102. The steering nozzle 102 is rotationally mounted via fasteners 166 at a top and bottom of the VTS support 160 about the steering axis 104 such that the steering nozzle 102 rotates with the VTS support 160 about the VTS axis 162 as described below. The steering axis 104 is perpendicular to the VTS axis 162. The reverse gate 110 is rotationally mounted to the left and right side brackets 158 about a reverse gate axis 168 (FIG. 12A). The reverse gate axis 168 extends generally laterally and horizontally and is parallel to the VTS axis 162. As can be seen in FIG. 17A, the reverse gate axis 168 is offset from the VTS axis 162, with the reverse gate axis 168 being disposed vertically lower than the VTS axis 162. Threaded fasteners 170 are used to connect the reverse gate 110 to the side brackets 158. As can be seen in FIG. 12C for example, the left and right brackets 158 are disposed between the reverse gate 110 and the VTS support 160. It is contemplated that the reverse gate 110 could be rotationally mounted about the reverse gate axis 168 to the side walls 95 of the tunnel 94 directly or through suitable brackets. It is also contemplated that the side brackets 158 could be connected to the sides of the jet pump 99.

Turning now to FIGS. 9A to 9D, the left side bracket 158 will be described in more detail. The right side bracket 158 is a mirror image of the left side bracket 158 and as such will not be described in detail herein.

The side bracket 158 has a pair of tabs 172 having apertures 174 defined therein used to fasten the side bracket 158 to the bosses 159 of the venturi 100. From the tabs 172, a pair of legs 176 extends laterally to a central portion 178 of the side bracket 158. The central portion 178 defines a pair of vertically spaced bores 180 therein. The bores 180 are adapted to receive fasteners used to attach springs used in alternative embodiments of the jet propulsion unit 84 described below. It is contemplated that the bores 180 could be omitted. From the central portion 178, a plate 182 extends rearwardly. The plate 182 defines vertically spaced apertures 184 and 186. The aperture 184 is adapted to receive the fastener 164 used to connect the VTS support 160 to the bracket 158. The aperture 186 is adapted to receive the fastener 170 used to connect the reverse gate 110 to the bracket 158. The legs 176 space the plate 182 laterally from the venturi 100 thereby providing the space necessary to receive the VTS support 160 between the bracket 158 and the venturi 100.

Figure 9B:
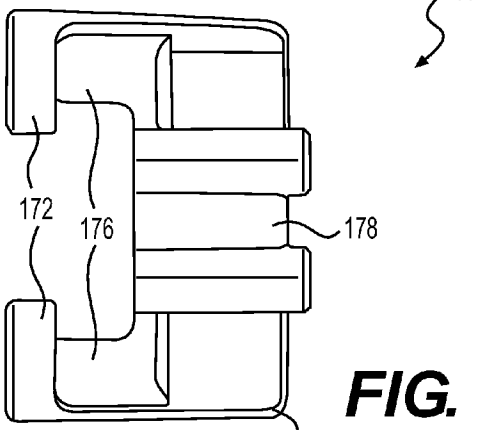
FIG. 9B is a front elevation view of the side bracket of FIG. 9A.
Figure 9D:
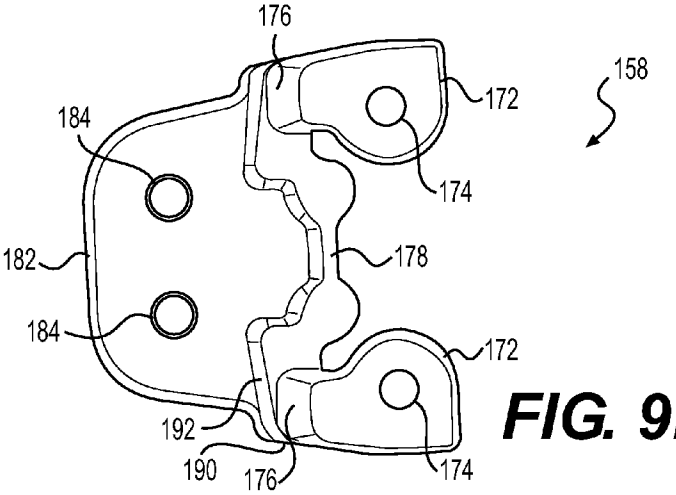
FIG. 9D is a right side elevation view of the side bracket of FIG. 9A.
Figure 9A:
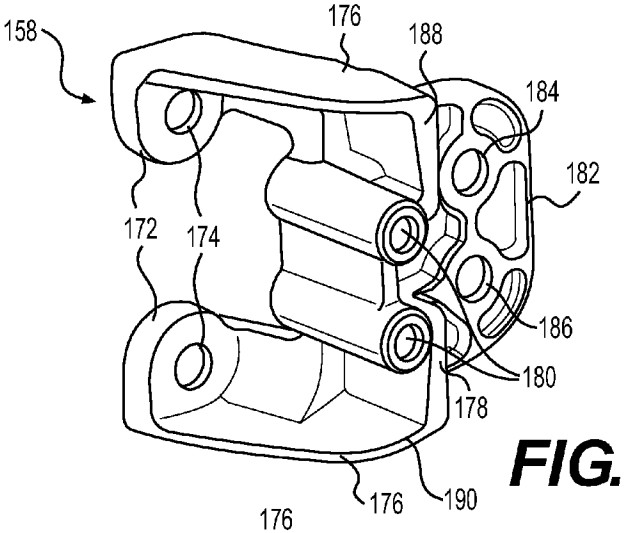
FIG. 9A is a perspective view, taken from a front, left side of a left side bracket of the jet propulsion system of FIG. 8.
Figure 9C:
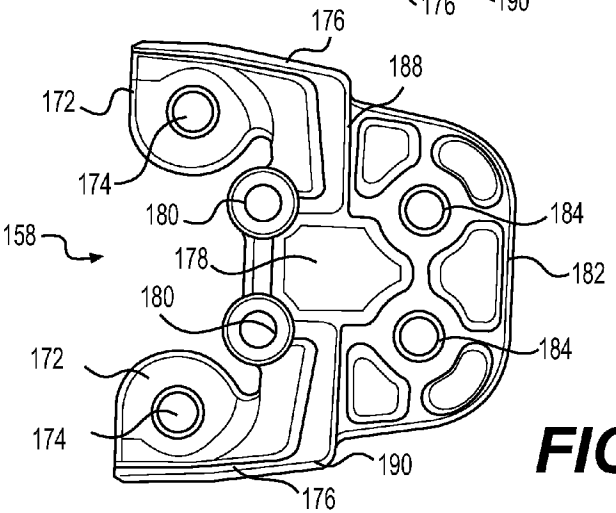
FIG. 9C is a left side elevation view of the side bracket of FIG. 9A.

The central portion 178 of the side bracket 158 defines an upper reverse gate stopper 188. As will be described below, the reverse gate 110 abuts the upper reverse gate stopper 188 when the reverse gate 110 is in its fully raised position. The bottom of the central portion 178 and the lower one of the legs 176 of the side bracket 158 together define a lower reverse gate stopper 190. As will be described below, the reverse gate 110 abuts the lower reverse gate stopper 190 when the reverse gate 110 is in its fully lowered position. The central portion 178 of the side bracket 158 also defines a VTS down stopper 192 (FIG. 9D). As will be described below, the VTS support 160 abuts the VTS down stopper 192 when the VTS support 160 is in its fully lowered position.

Figure 15B:
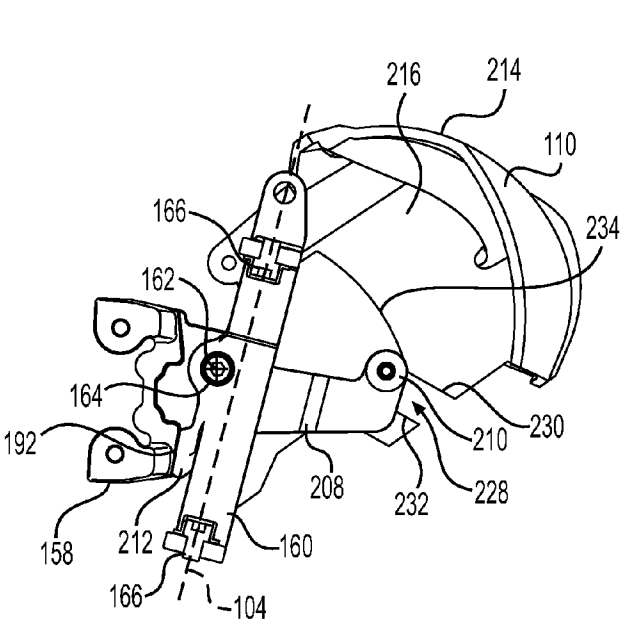
FIG. 15B is a cross-sectional view of the jet propulsion of FIG. 8 in the position shown in FIG. 15A taken through line 15B-15B of FIG. 15C and with the jet pump, the venturi and the steering nozzle removed.

With reference to FIG. 10, the VTS support 160 will be described in more detail. As previously mentioned, the VTS support 160 is generally ring-shaped, but other shapes are contemplated. The VTS support 160 includes upper and lower arcuate portions 194 connected together by two generally C-shaped portions 196. The arcuate portions 194 define apertures 198 (only one of which is shown) used to rotationally connect the steering nozzle 102 to the VTS support 160 about the steering axis 104 using the fasteners 166. The upper arcuate portion 194 has an upwardly extending tab 200 defining an aperture 202. The tab 200 and aperture 202 allow the VTS support 160 to be used in the jet propulsion system 84' described in greater detail below. The tab 200 and aperture 202 are not used in the jet propulsion system 84, and it is therefore contemplated that they could be omitted. The C-shaped portions 196 define apertures 204 used to receive the fasteners 164 to fasten the VTS support 160 to the side brackets 158 about the VTS axis 162. The C-shaped portions 196 also provide the space necessary to receive the link 206 (FIG. 12C) used to connect the steering nozzle 102 to the steering assembly of the watercraft 10. A pair of generally L-shaped arms 208 extends rearward from the pair of C-shaped portions 196. It is contemplated that the arms 208 could have other shapes. A follower, in the form of a roller 210, is provided on the rear part of each arm 208, such that the rollers 210 are disposed rearwardly of the VTS axis 162 and the reverse gate axis 168. The rollers 210 are arranged so as to be disposed laterally between the reverse gate 110 and the arms 208 in the assembled jet propulsion system 84. The rollers 210 are removable to allow the VTS support 160 to be used in the jet propulsion system 84' described in greater detail below. It is contemplated that the rollers 210 could be replaced by other types of followers. For example, the followers could be extensions of the arms 208 or pins connected to the arms 208. The VTS support 160 also has two legs 212 extending downwardly from the C-shaped portions 196. The front surface of the legs 212 each abut the VTS down stopper 192 of a corresponding one of the side brackets 158 when the VTS support 160 is in its fully lowered position as can be seen in FIG. 15B for example.

Figure 11A:
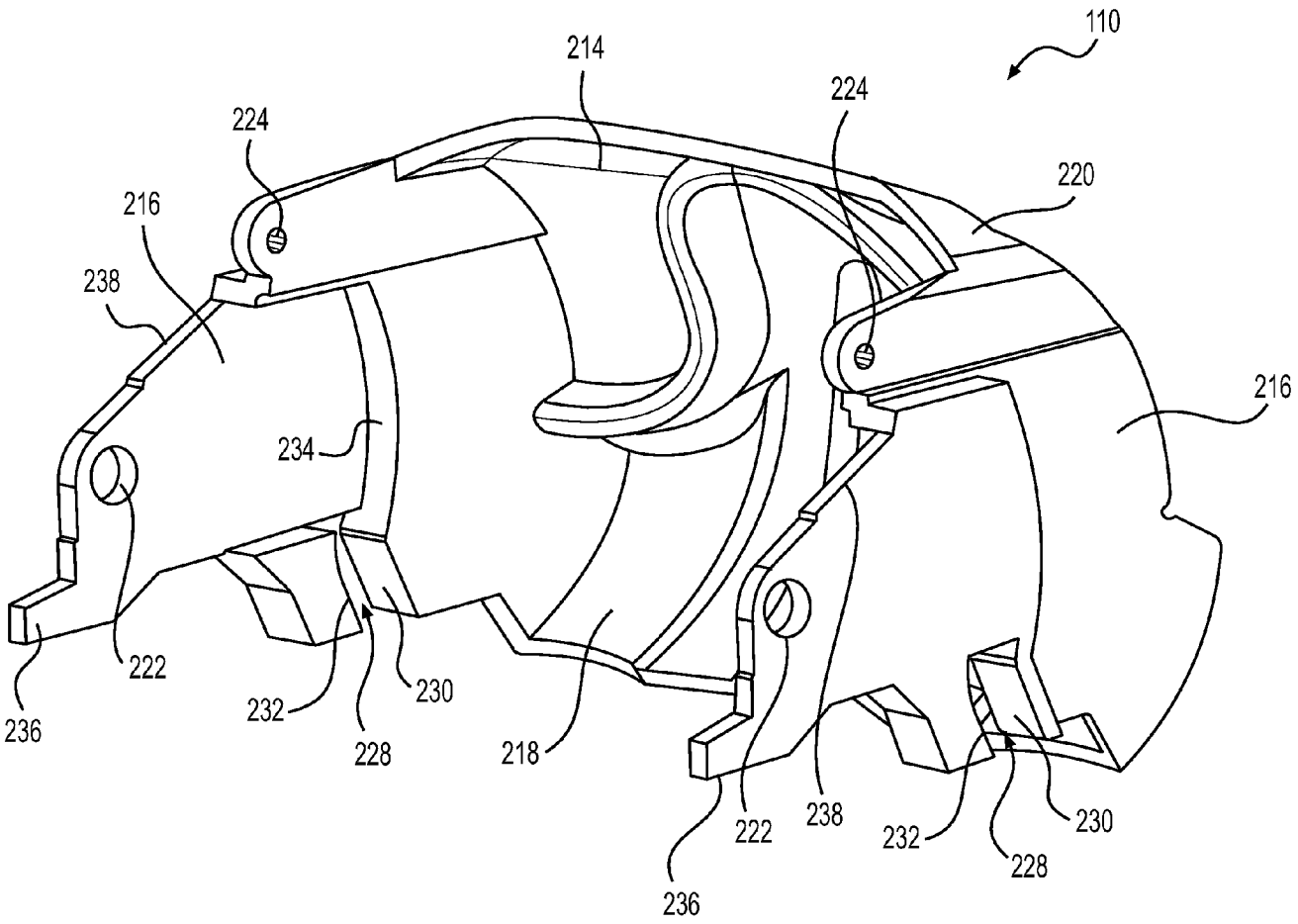
FIG. 11A is a perspective view taken from a front, left side of a reverse gate of the jet propulsion system of FIG. 8.

Turning now to FIG. 11A, the reverse gate 110 will be described in more detail. The reverse gate 110 has a reverse gate body 214 and two side walls 216 connected to the sides of the reverse gate body 214. The reverse gate body 214 has an inner arcuate surface 218 and an outer arcuate surface 220. When the reverse gate 110 is rotated about the reverse gate axis 168 such that at least a portion of the inner arcuate surface 218 faces at least a portion of the outlet of the steering nozzle 102, the inner arcuate surface 218 redirects at least a portion of a jet of water being expelled from the steering nozzle 102. Each side wall 216 has an aperture 222 used to connect the reverse gate 110 to the side brackets 158 about the reverse gate axis 168 using the fasteners 170. Each side wall 216 also has an aperture 224. One of the two apertures 224 (the left aperture 224 in the embodiment shown) is used to operatively connect the reverse gate 110 to an actuator 226 (schematically shown in FIG. 1) that is used to rotate the reverse gate 110 about the reverse gate axis 168. The other one of the apertures 224 is not used and could be omitted. However, by providing two apertures 224 on the reverse gate 110, the jet propulsion system 84 provides flexibility by allowing the actuator 226 to be connected to either side of the reverse gate 110. The actuator 226 and its connection to the reverse gate 110 will be described in greater detail further below.

Each side wall 216 defines a channel 228 inside which the corresponding roller 210 of the VTS support 160 is received for certain positions of the reverse gate 110 as will be described below. It is contemplated that in some embodiments, the channel 228 could be replaced by a slot. In the present embodiment, the width of the channels 228 is slightly larger than the diameter of the rollers 210. It is contemplated that the channels 228 could be wider. Each channel 228 is defined between a VTS down abutment surface 230 and a VTS up abutment surface 232. It is contemplated that the laterally outward sides of the channels 228 could be closed by a surface such as the side walls 216 for example. The VTS down abutment surfaces 230 are straight. The VTS up abutment surfaces 232 have a straight portion followed by an arcuate portion. When the rollers 210 are disposed in the channels 228 and the reverse gate 110 is rotated downwardly about the reverse gate axis 168 (clockwise in FIGS. 12A and 12B), the rollers 210 abut the VTS down abutment surfaces 230 and are displaced along the VTS down abutment surfaces 230 which results in the VTS support 160 rotating downwardly about the VTS axis 162 (clockwise in FIGS. 12A and 12B), as will be described in greater detail below. As the VTS support 160 rotates downwardly, the steering nozzle 102 rotates downwardly with it. This is referred to as trim down. When the rollers 210 are disposed in the channels 228 and the reverse gate 110 is rotated upwardly about the reverse gate axis 168 (counter-clockwise in FIGS. 12A and 12B), the rollers 210 abut the VTS up abutment surfaces 232 and are displaced along the VTS up abutment surfaces 232 which results in the VTS support 160 rotating upwardly about the VTS axis 162 (counter-clockwise in FIGS. 12A and 12B), as will be described in greater detail below. As the VTS support 160 rotates upwardly, the steering nozzle 102 rotates upwardly with it. This is referred to as trim up. It is contemplated that the VTS up abutment surfaces 232 could be omitted, in which case one or more springs would be connected between the steering nozzle 102 or the VTS support 160 and the side brackets 158, the jet pump 99, the venturi 100 or the tunnel 94 to bias the roller 210 against the VTS down abutment surfaces 230. Each side wall 216 is also provided with a VTS hold abutment surface 234. The VTS hold abutment surface 234 is arcuate and has the reverse gate axis 168 as a center of curvature. As can be seen, the VTS hold abutment surface 234 extends from the VTS down abutment surface 230 so as to form a reflex angle at their vertex. Once the reverse gate 110 rotates downwardly about the reverse gate axis 168 beyond a certain angle, the VTS support 160 reaches its fully lowered position as illustrated in FIGS. 15A to 18C. When the reverse gate 110 is positioned in the range of angle between this angle and the angle corresponding to the fully lowered position of the reverse gate 110 (illustrated in FIGS. 18A to 18C), the rollers 210 abut the VTS hold abutment surfaces 234 and this engagement maintains the VTS support 160, and therefore the steering nozzle 102, in its fully lowered position, as will be discussed in greater detail below. It is contemplated that the VTS hold abutment surfaces could be omitted, in which case it is contemplated that the VTS support 160 could be held in its fully lowered position by one or more springs connected between the steering nozzle 102 or the VTS support 160 and the side brackets 158, the jet pump 99, the venturi 100 or the tunnel 94, or by some other mechanism that would bias the VTS support 160 against the VTS down stopper 192. It is contemplated that the abutment surfaces 230, 232, 234 could be provided on the VTS support 160 and that the followers, in this case the rollers 210, could be provided on the side walls 216. It is also contemplated that the abutment surfaces 230, 232, 234 and the followers could be provided elsewhere relative to the VTS axis 162, such as forwardly, above or below.

Figure 18B:
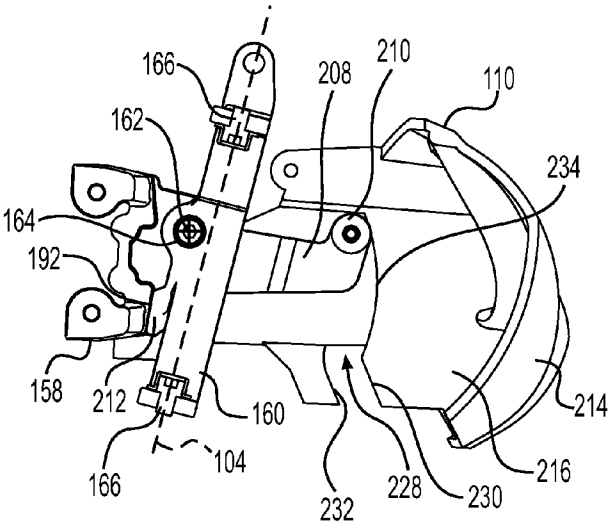
FIG. 18B is a cross-sectional view of the jet propulsion of FIG. 8 in the position shown in FIG. 18A taken through line 18B-18B of FIG. 18C and with the jet pump, the venturi and the steering nozzle removed.
Figure 18A:
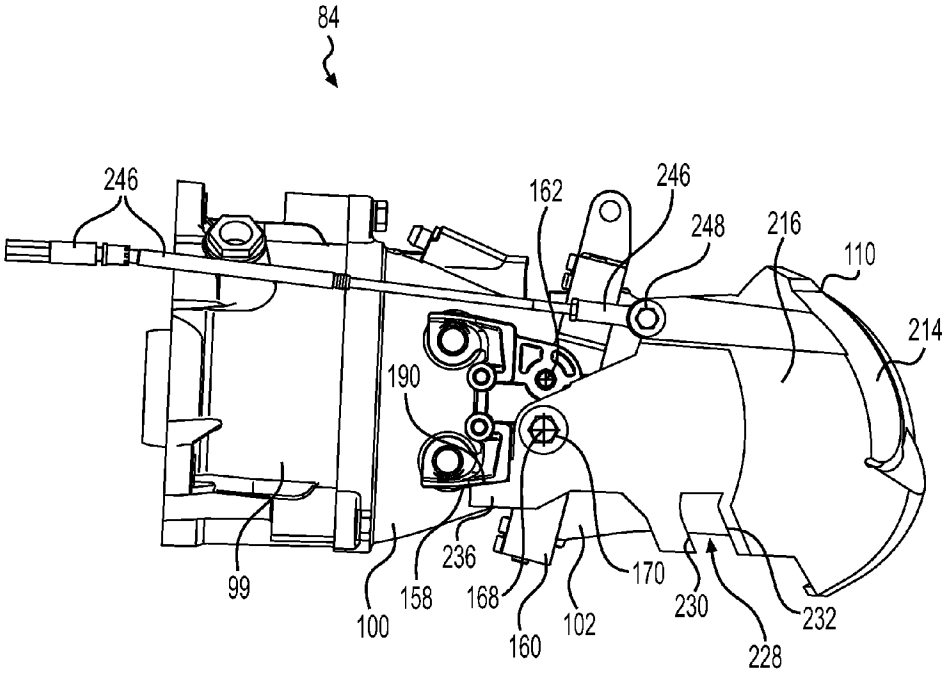
FIG. 18A is a left side elevation view of the jet propulsion system of FIG. 8 with the VTS in a fully lowered position and the reverse gate in a fully lowered position.

Each side wall 216 is also provided with a leg 236 that abuts its corresponding lower reverse gate stopper 190 when the reverse gate 110 is in its fully lowered position as shown in FIG. 18A. Each side wall 216 also defines a surface 238 that abuts its corresponding upper reverse gate stopper 188 when the reverse gate 110 is in its fully raised position as shown in FIG. 12A.

Figure 11B:
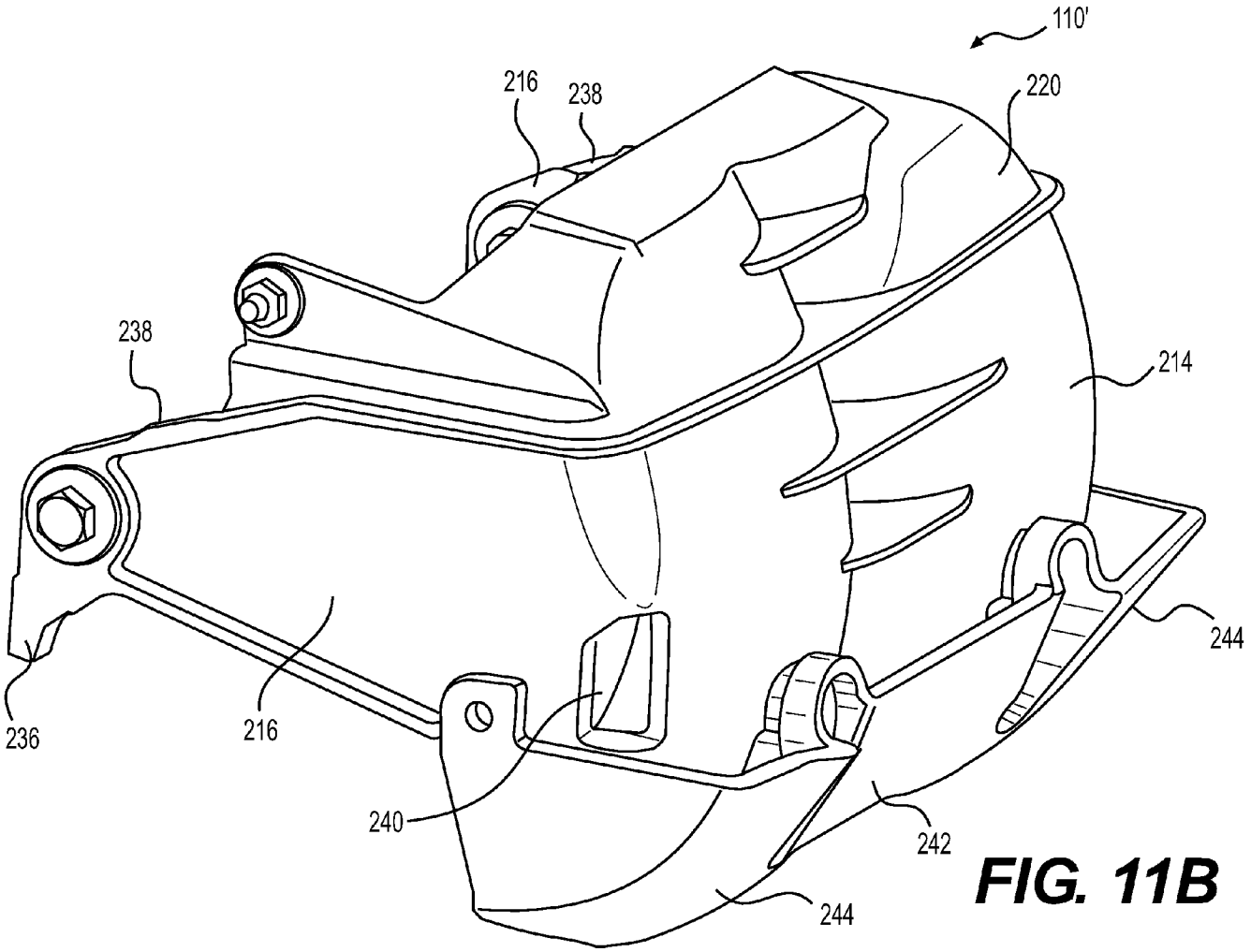
FIG. 11B is a perspective view taken from a rear, left side of an alternative embodiment of a reverse gate of the jet propulsion system of FIG. 8.

FIG. 11B illustrates a reverse gate 110' that is an alternative embodiment of the reverse gate 110. For simplicity, the components of the reverse gate 110' which are similar to the components of the personal reverse gate 110 described above will be given the same reference numerals and will not be described again. The construction of the reverse gate 110' is substantially the same as that of the reverse gate 110 described above except for the addition of two apertures 240 in the reverse gate body 214 (one on each side) and of a deflector plate 242 fastened to the reverse gate body 214 and the side walls 216. The apertures 240 create a lateral jet of water when the reverse gate 110 is lowered and the steering nozzle 102 is turned while the jet pump 99 is in operation, thus assisting in steering of the watercraft 10. The deflector plate 242 has two deflectors 244 that are spaced from the outer arcuate surface 220 of the reverse gate body 214. The deflectors 244 increase the drag created by the reverse gate 110' in the water when the reverse gate 110' is lowered (compared to the reverse gate 110), thus assisting in decelerating the watercraft 10. The deflectors 244 can further be used to generate a downward thrust during deceleration. Additional details regarding apertures similar to the apertures 240 and deflectors similar to the deflectors 244 can be found in U.S. Pat. No. 7,674,144, issued Mar. 9, 2010, the entirety of which is incorporated herein by reference. Although not shown, the side walls 216 of the reverse gate 110' are provided with the abutment surfaces 230, 232, 234.

With reference to FIGS. 1, 8, and 12A, the actuator 226 and its connection to the reverse gate 110 will be described in more detail. The actuator 226 is located inside the engine compartment 20 near the tunnel 94. It is contemplated that it could be located in the tunnel 94 or more forwardly inside the engine compartment 20. The actuator 226 is connected to the reverse gate 110 via a plurality of rigid linkages 246. The rear end of the rearmost linkage 246 is fastened to the reverse gate 110 with a fastener 248 inserted inside a corresponding one of the apertures 224. It is contemplated that the rigid linkages 246 could be replaced by a push-pull cable. The actuator 226 is an electrical linear actuator that pushes or pulls on the linkages 246 to cause the reverse gate 110 to rotate down or up respectively about the reverse gate axis 168 and as a result causes the VTS support 160 and steering nozzle 102 to trim down or up respectively over a certain range of rotation of the reverse gate 110. It is contemplated that the trim range in which the reverse gate 110 would not interfere with a jet of water expelled by the steering nozzle 102 could be from 8.5 degrees above a neutral position to 7.5 degrees below a neutral position, but other ranges are contemplated. It is also contemplated that the trim range within which the driver can control the trim position of the VTS support 160 could be less than the full trim range of which the VTS support 160 is mechanically capable. For example, even if mechanically the VTS support 160 can be trimmed from 8.5 degrees above a neutral position to 7.5 degrees below a neutral position without the reverse gate interfering with a jet of water expelled by the steering nozzle 102, the driver may only be allowed to manually input trim positions from 3 degrees above a neutral position to 3 degrees below a neutral position. In such an embodiment, the trim positions outside this range would either not be mechanically accessible via the corresponding manual actuator or would be accessible based on an automatic control of the actuator 226 based on various inputs to an electronic control unit of the watercraft 10. It is contemplated that other types of actuators could be used, such as, for example, a hydraulic actuator. It is also contemplated that the actuator 226 could be a manual actuator such as a lever actuated by the driver of the watercraft. It is also contemplated that the actuator 226 could be a rotary actuator having a rack and pinion assembly or coupled to a lead screw used to create linear displacement of the linkages 246. It is also contemplated that the actuator 226 could be a rotary actuator connected directly or via a gear box to the reverse gate 110 so as to rotate the reverse gate 110 directly about the reverse gate axis 168.

The actuator 226 is controlled based on signals received from sensors connected to one or more of the lever 77, and buttons 80 for the personal watercraft 10, and from sensors connected to one or more of the pedal 147, buttons (not shown), and lever (not shown) for the boat 120, or from a steering position sensor (not shown) so as to provide the VTS position and reverse gate position desired by the driver of the watercraft. It is contemplated that the actuator 226 could be automatically controlled by an electronic control unit without any driver intervention based on conditions of the watercraft and engine 22, such as vehicle speed and engine speed so as to provide the appropriate VTS position and reverse gate position. It is also contemplated that a combination of automatic control and driver input could be used to control the actuator 226. For example, the VTS position and some reverse gate positions could be automatically controlled, but the driver (through a lever, button, or pedal) would provide the input to the actuator 226 that a reverse operation of the watercraft is desired.

Turning now to FIGS. 12A to 18C, the operation of the jet propulsion system 84, and more specifically the movement of the VTS support 160, steering nozzle 102, and reverse gate 110, will be described. It should be understood that FIGS. 12A to 18C only show some of the arrangements of these components and that arrangements intermediate those shown are possible. For simplicity, the description will be made only with respect to one side of the jet propulsion system 84. Although not specifically shown in these figures, it should also be understood that an output portion of the actuator 226 has moved to provide the positions of the reverse gate 110 that are shown. As such, when the reverse gate 110 is shown as having been rotated by a certain number of degrees in one direction from one position to another, it should be understood that this rotation has been caused by the output portion of the actuator 226 moving by a proportionally corresponding amount. Also, in the explanations provided below, the upward and downward rotations of the components of the reverse gate 110 will be referred to as clockwise and counter-clockwise rotations respectively, which are the rotations as they would be understood looking at the figures having an A or a B suffix in FIGS. 12A to 18C.

In the arrangement shown in FIGS. 12A to 12C, the VTS support 160 is in a VTS up position where the steering nozzle 102 directs a jet of water from the venturi 100 slightly upwardly. More specifically, the steering nozzle 102 is angled 8.5 degrees above a neutral position in the VTS up position, although other angles are contemplated. As mentioned above, even though the VTS support 160 is mechanically capable of reaching this position, it is contemplated that movement of the VTS support 160 could be limited to a smaller angle. The reverse gate 110 is in a stowed position (i.e. a position where it does not interfere with the jet of water coming from the steering nozzle 102). The upper reverse gate stopper 188 prevents the reverse gate 110 from rotating further counter-clockwise. Unless the reverse gate 110 is rotated clockwise by the actuator 226, the VTS support 160 is prevented from rotating about the VTS axis 162 as it is being held in place by the roller 210 disposed in the channel 228 between the VTS down abutment surface 230 and the VTS up abutment surface 232.

Figure 13B:
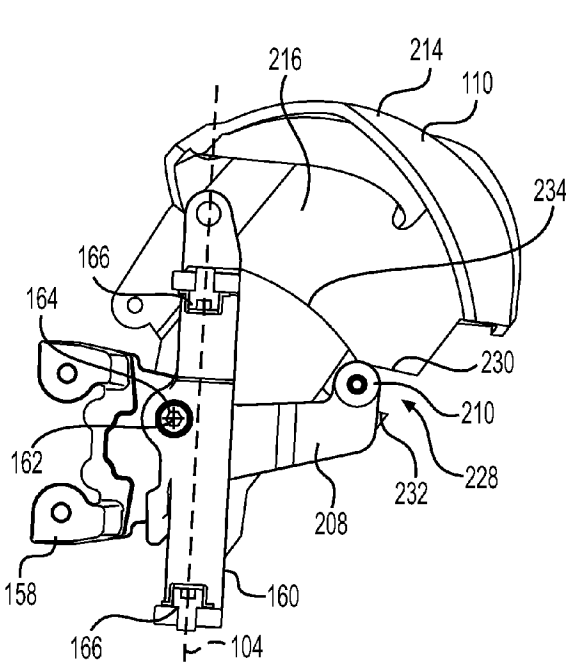
FIG. 13B is a cross-sectional view of the jet propulsion of FIG. 8 in the position shown in FIG. 13A taken through line 13B-13B of FIG. 13C and with the jet pump, the venturi and the steering nozzle removed.
Figure 13A:
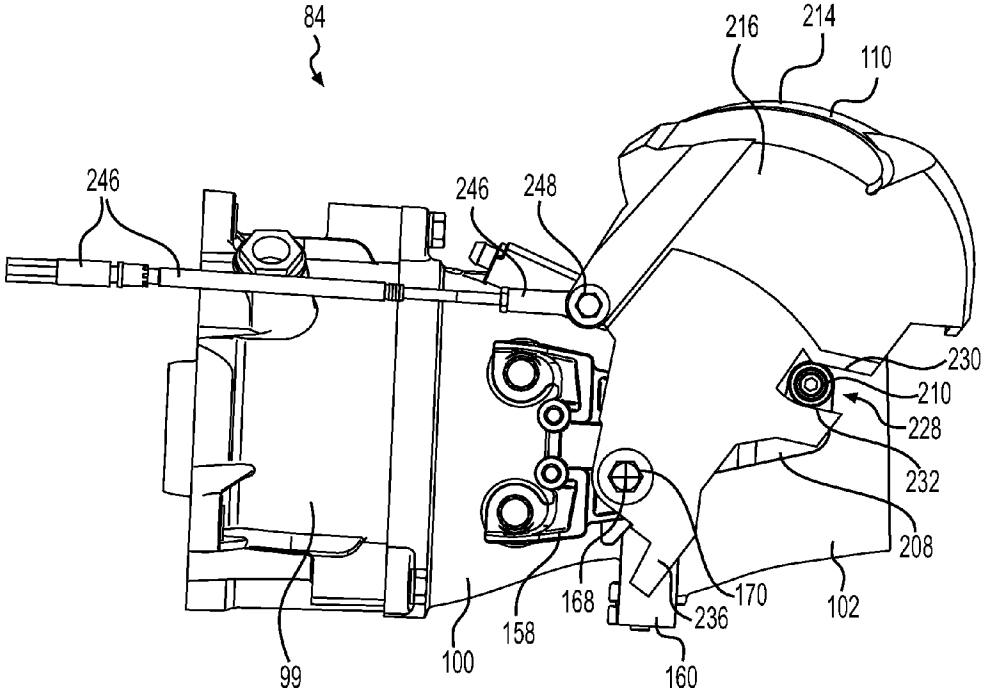
FIG. 13A is a left side elevation view of the jet propulsion system of FIG. 8 with the VTS in a neutral position and the reverse gate in a stowed position.
Figure 13C:
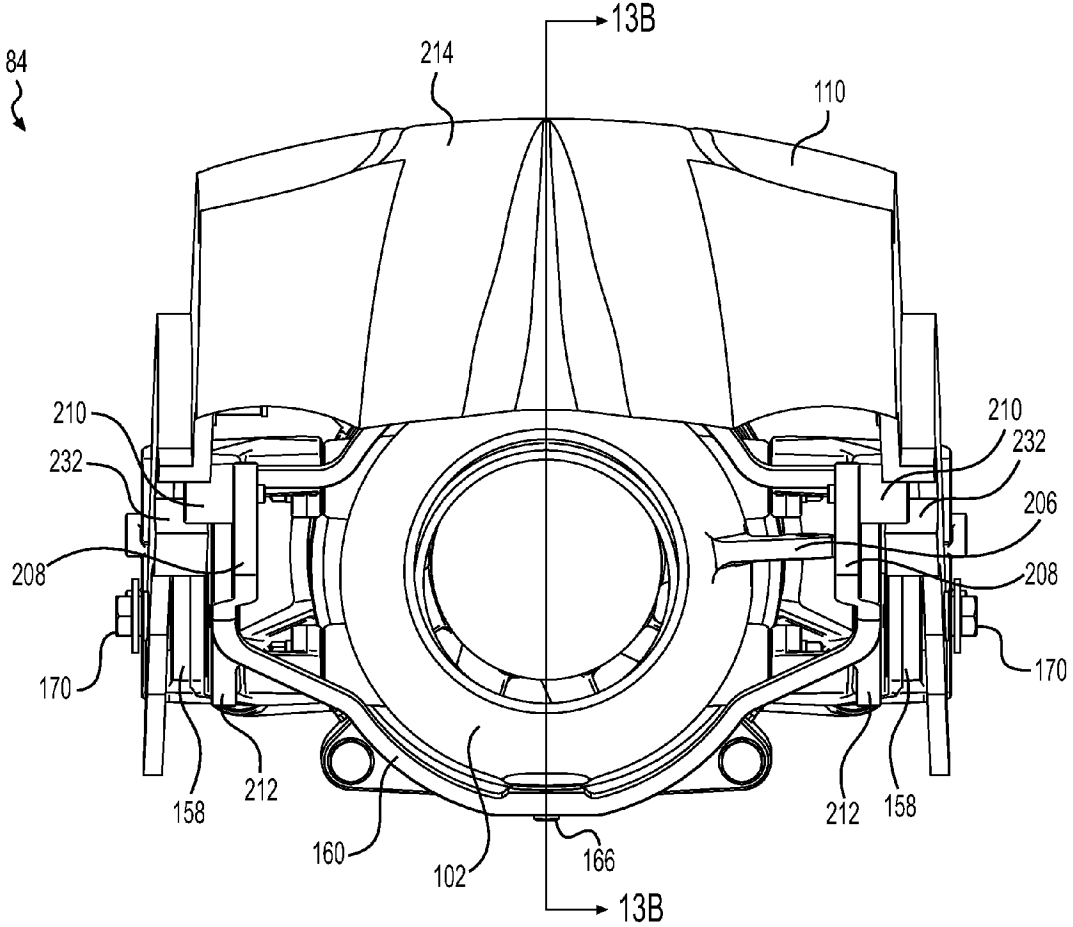
FIG. 13C is a rear side elevation view of the jet propulsion system of FIG. 8 in the position shown in FIG. 13A.
Figure 14B:
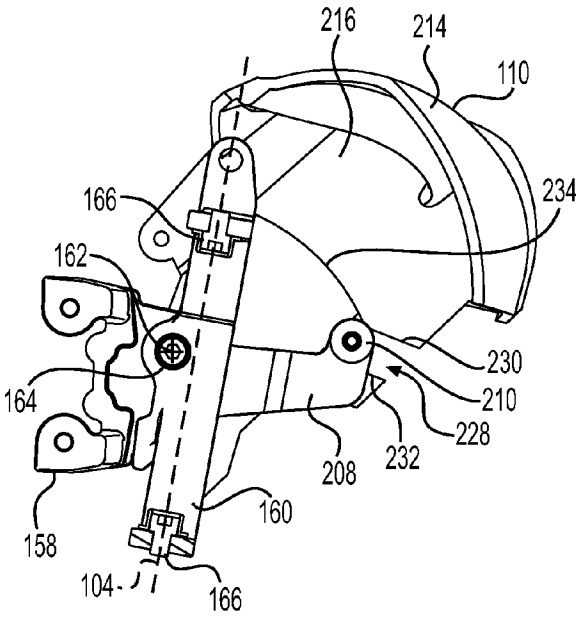
FIG. 14B is a cross-sectional view of the jet propulsion of FIG. 8 in the position shown in FIG. 14A taken through line 14B-14B of FIG. 14C and with the jet pump, the venturi and the steering nozzle removed.
Figure 14A:
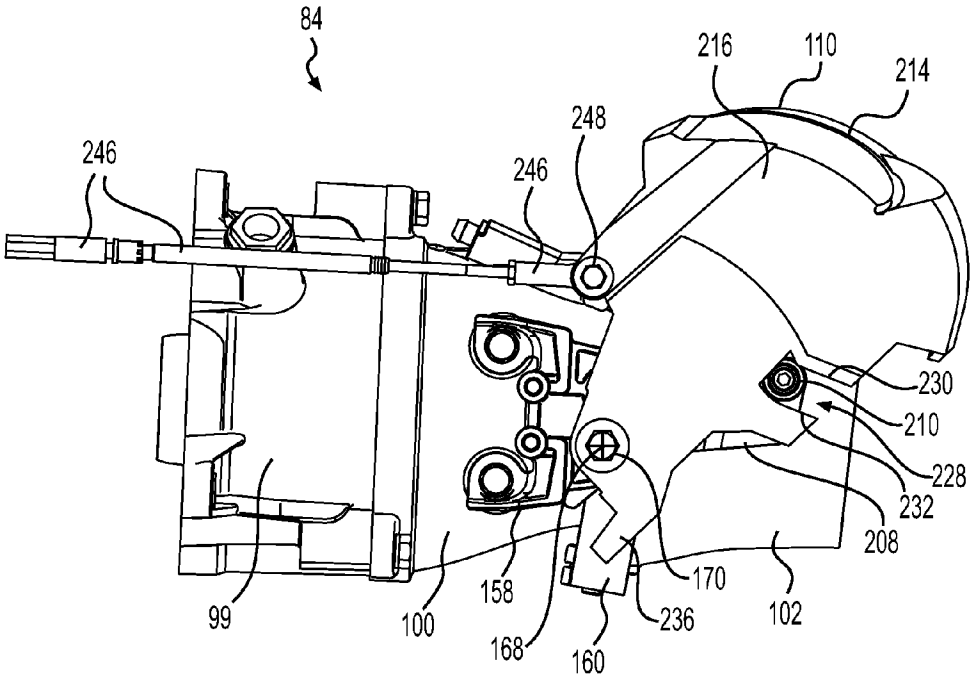
FIG. 14A is a left side elevation view of the jet propulsion system of FIG. 8 with the VTS in a down position and the reverse gate in a stowed position.
Figure 14C:
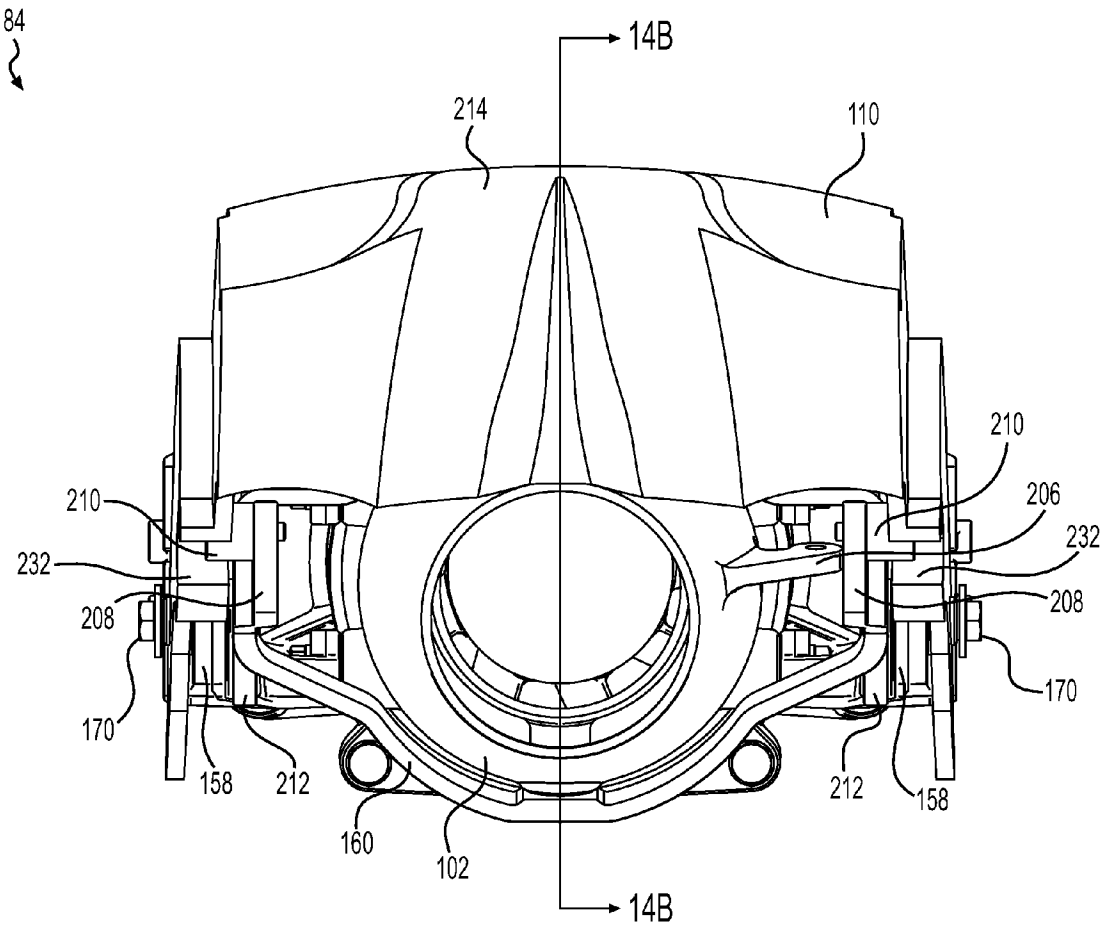
FIG. 14C is a rear side elevation view of the jet propulsion system of FIG. 8 in the position shown in FIG. 14A.

As the reverse gate 110 is rotated clockwise about the reverse gate axis 168 from the angle shown in FIGS. 12A to 12C to the angle shown in FIGS. 13A to 13C, and then to the angle shown in FIG. 14A to 14C, the roller 210 is displaced along the VTS down abutment surface 230, causing the VTS support 160 to rotate clockwise about the VTS axis 162. As the VTS support 160 rotates about the VTS axis 162 from the position shown in FIGS. 12A to 12C to the position shown in FIGS. 14A to 14C, the position of the reverse gate 110 relative to the VTS support 160 changes but the reverse gate 110 does not interfere with a jet of water being expelled by the steering nozzle 102. As such, the positions of the reverse gate 110 shown in FIGS. 13A to 14C are also stowed positions. In the arrangement shown in FIGS. 13A to 13C, the VTS support 160 is in a VTS neutral position where the steering nozzle 102 directs a jet of water from the venturi 100 generally horizontally. In this embodiment, the VTS neutral position corresponds to the longitudinal axis of the steering nozzle 102 being 3.5 degrees above the longitudinal axis of the jet pump 99, but other angles are contemplated. For example, it is contemplated that the VTS neutral position could correspond to the longitudinal axis of the steering nozzle 102 being coaxial with the longitudinal axis of the jet pump 99. In the arrangement shown in FIGS. 14A to 14C, the VTS support 160 is in a VTS down position where the steering nozzle 102 directs a jet of water from the venturi 100 slightly downwardly. More specifically, the steering nozzle 102 is angled 7.5 degrees below a neutral position in the VTS down position, although other angles are contemplated.

Figure 15A:
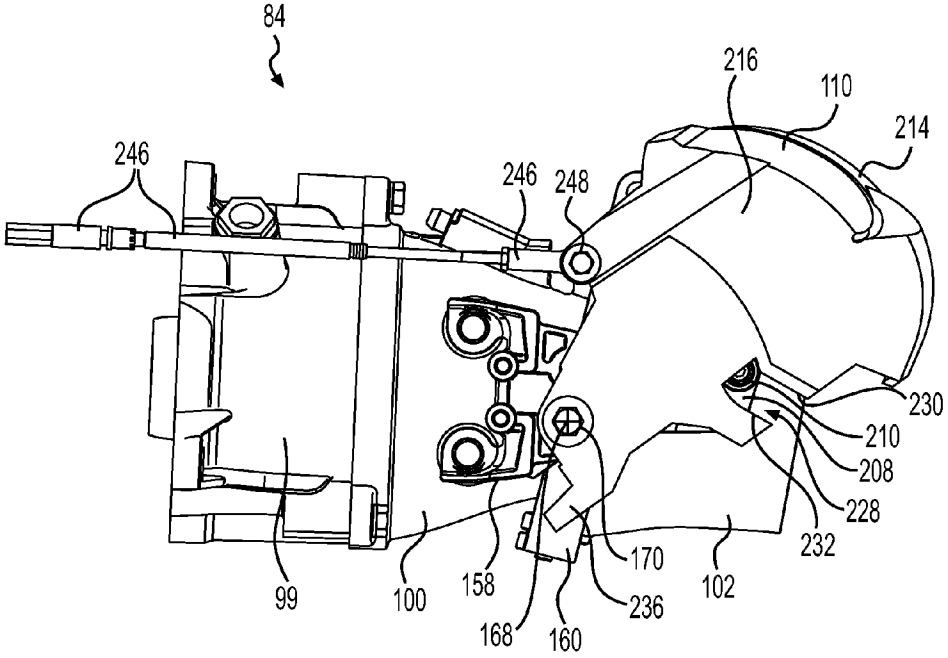
FIG. 15A is a left side elevation view of the jet propulsion system of FIG. 8 with the VTS in a fully lowered position and the reverse gate in a lowered position.
Figure 15C:
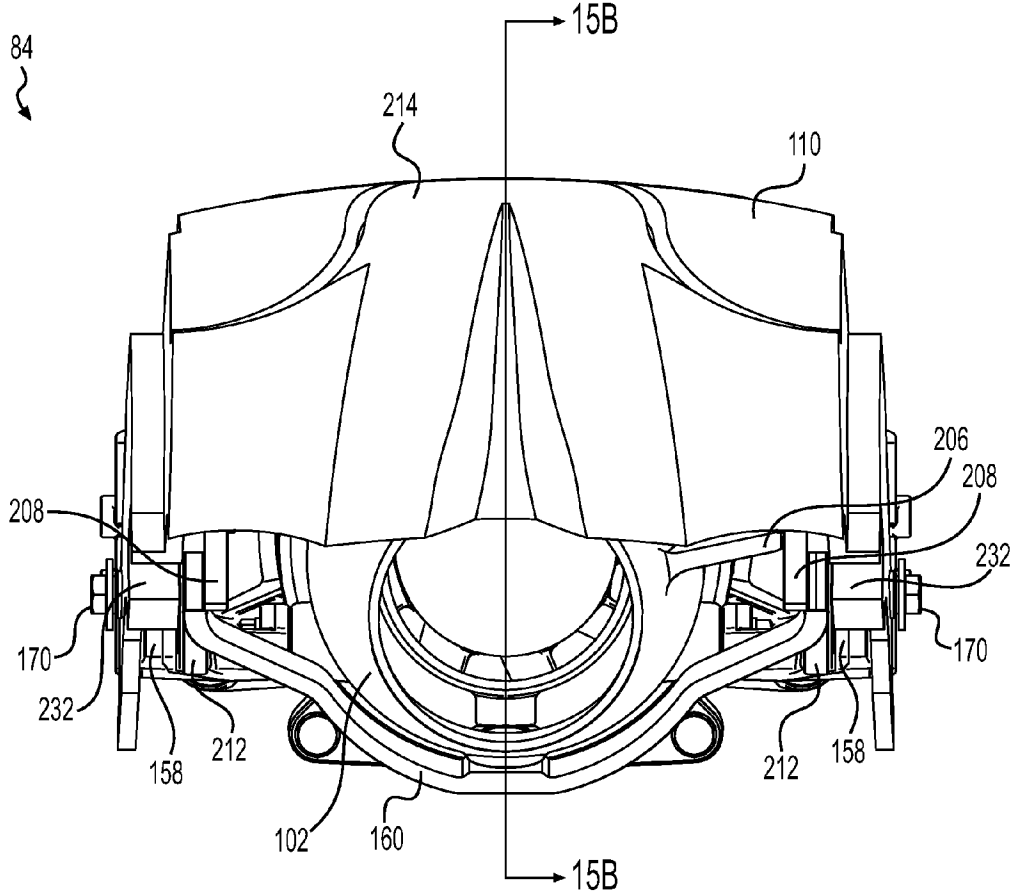
FIG. 15C is a rear side elevation view of the jet propulsion system of FIG. 8 in the position shown in FIG. 15A.
Figure 16B:
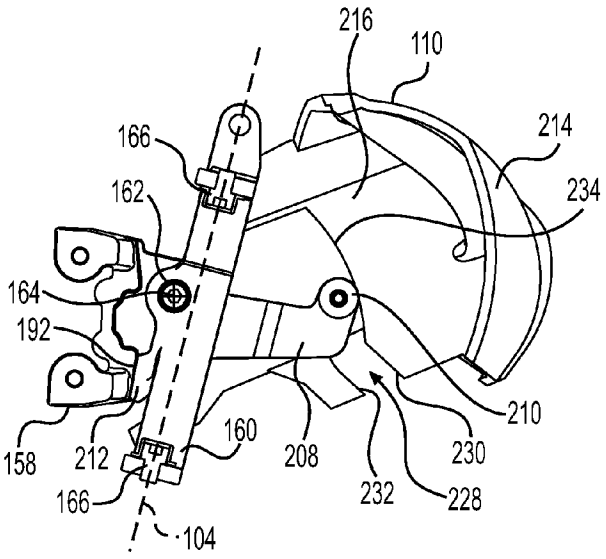
FIG. 16B is a cross-sectional view of the jet propulsion of FIG. 8 in the position shown in FIG. 16A taken through line 16B-16B of FIG. 16C and with the jet pump, the venturi and the steering nozzle removed.
Figure 16A:
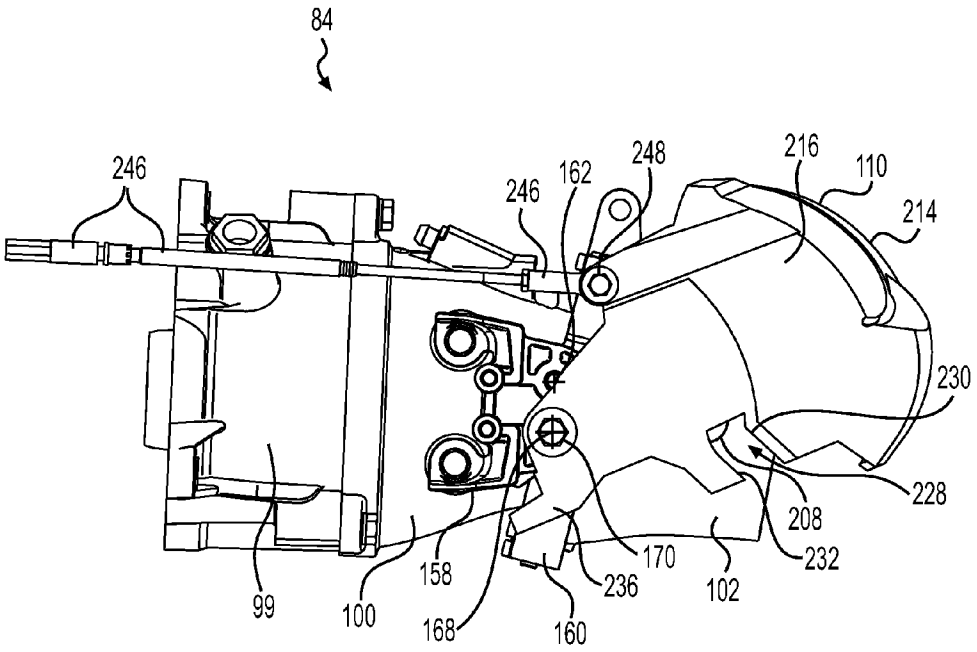
FIG. 16A is a left side elevation view of the jet propulsion system of FIG. 8 with the VTS in a fully lowered position and the reverse gate in another lowered position.
Figure 16C:
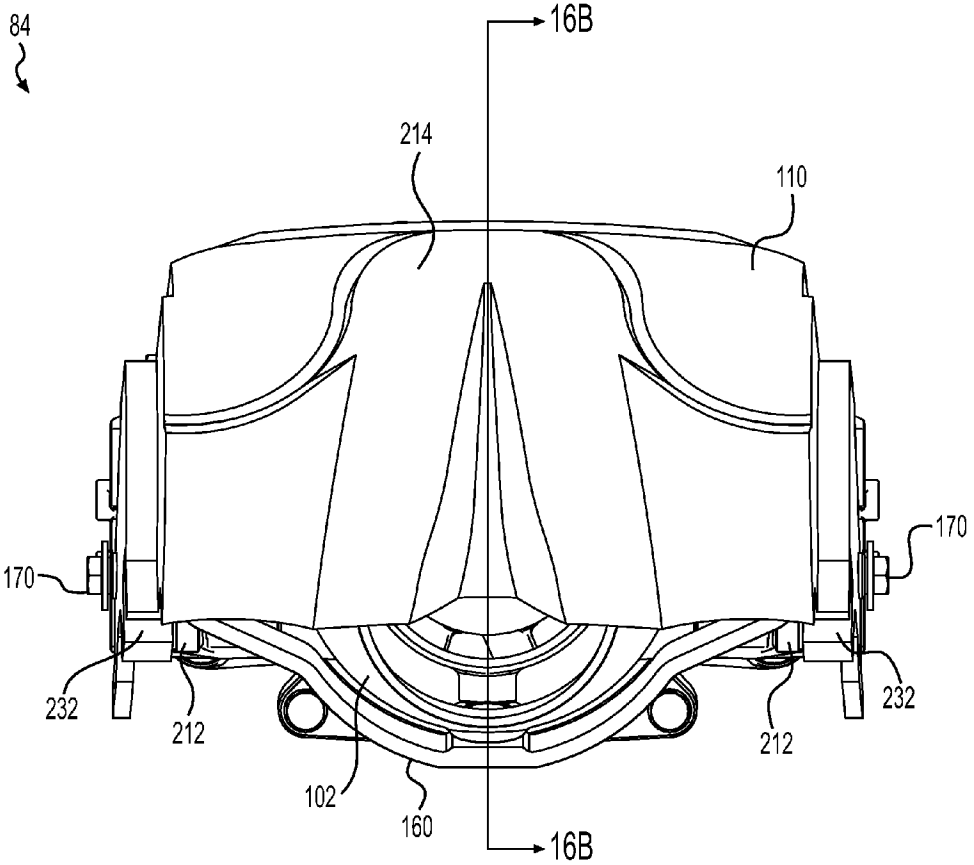
FIG. 16C is a rear side elevation view of the jet propulsion system of FIG. 8 in the position shown in FIG. 16A.

As the reverse gate 110 is rotated clockwise about the reverse gate axis 168 from the angle shown in FIGS. 14A to 14C to the angle shown in FIGS. 15A to 15C, the leg 212 of the VTS support 160 comes in contact with the VTS down stopper 192 and the VTS support 160 and steering nozzle 102 are in the fully lowered VTS position. In the illustrated embodiment, the fully lowered VTS position is 11.5 degrees below the neutral position, although other angles are contemplated. For example, it is contemplated that the fully lowered VTS position could be the same as the position illustrated in FIGS. 14A to 14C which correspond to the lowest position at which the VTS support 160 can be trimmed down before further rotation of the reverse gate 110 would start interfering with a jet of water expelled by the steering nozzle 102. As the reverse gate 110 continues to be rotated clockwise from the angle shown in FIGS. 15A to 15C to the angles shown in FIGS. 16A to 16C, then to the angle shown in FIGS. 17A to 17C, and then to the angle shown in FIGS. 18A to 18C, the VTS support 160 is maintained in the fully lowered VTS position by having the roller 210 abut and being displaced along the VTS hold abutment surface 234, thus preventing counter-clockwise rotation of the VTS support 160 about the VTS axis 162, which could otherwise occur due to the force of the water jet on the steering nozzle 102. In the positions shown in FIGS. 15A to 18C, the reverse gate 110 is in lowered positions and redirects the jet of water expelled from the steering nozzle 102. In the position shown in FIGS. 16A to 16C, the jet of water is redirected generally downwardly and as such the jet of water does not thrust the watercraft significantly forward or backward. In the position shown in FIGS. 18A to 18C, the leg 236 of the reverse gate 110 abuts the lower reverse gate stopper 190 and most of the jet of water is redirected toward a front of the watercraft which causes the watercraft to move in the reverse direction or to decelerate should the watercraft have forward momentum.

Figure 18C:
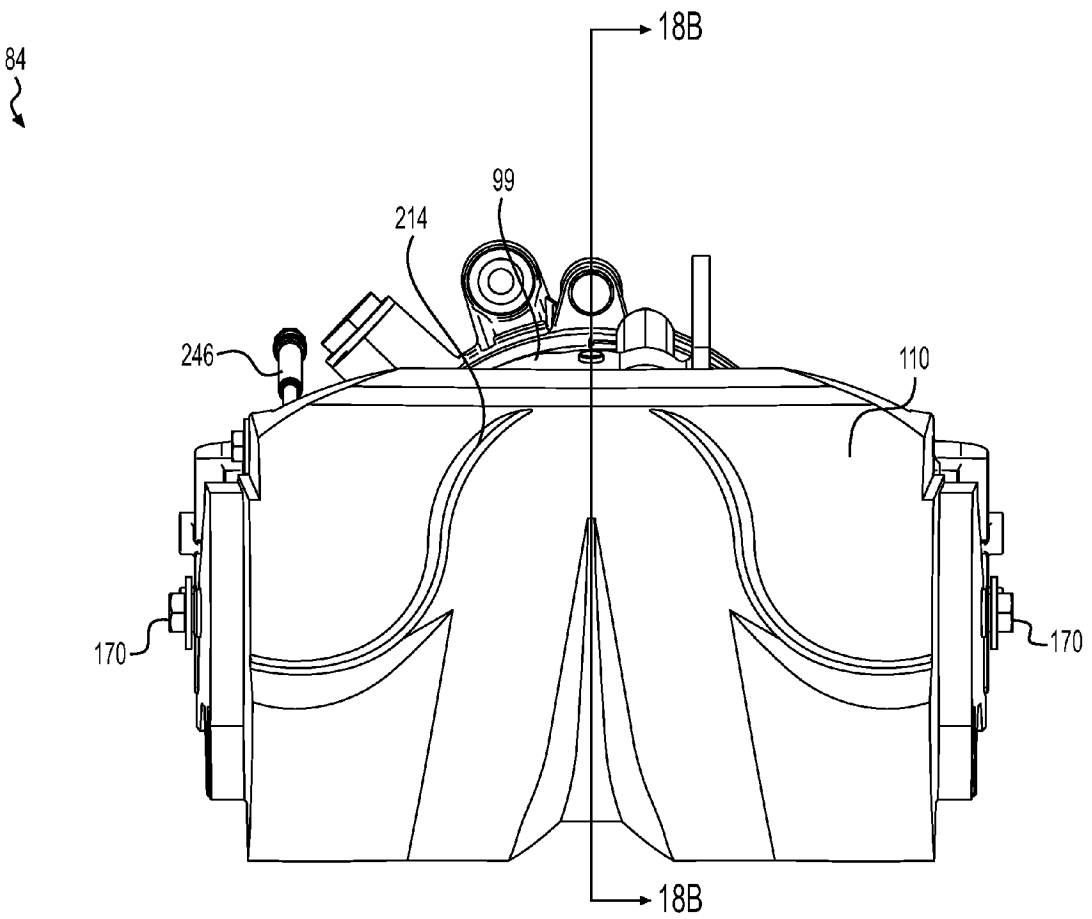
FIG. 18C is a rear side elevation view of the jet propulsion system of FIG. 8 in the position shown in FIG. 18A.

From FIGS. 18A to 18C, when the reverse gate 110 is rotated counter-clockwise about the reverse gate axis 168, the VTS support 160 remains fixed in the fully lowered VTS position until the position shown in FIGS. 15A to 15C. As the reverse gate 110 continues to rotate counter-clockwise from the position shown in FIGS. 15A to 15C, the roller 210 abuts and is displaced along the VTS up abutment surface 232 causing the VTS support 160 to rotate counter-clockwise about the VTS axis 162, and the reverse gate 110 to return to stowed positions. It should be understood that the direction of rotation of the reverse gate 110 can be changed at any time (i.e. it does not need to be rotated clockwise from the position shown in FIGS. 12A to 12C all the way to the position shown in FIGS. 18A to 18C before it can be rotated counter-clockwise, and vice versa). It should also be understood that the rotation of the reverse gate 110 can be stopped at any time to maintain a desired arrangement of the components. It is also contemplated that the actuator 226 could limit the movement of the reverse gate 110 to a rotational range that is less than the full rotational range of which the reverse gate 110 is mechanically capable.

It is contemplated that the VTS support 160 and reverse gate 110 (or 110') described above could be provided as a variable trim system and gate assembly used to modify or replace components of existing jet propulsion systems lacking the features of the jet propulsion system 84. Depending on the features of the jet propulsion system to be modified, such an assembly may also include one or more of the steering nozzle 102, the venturi 100, the side brackets 158 (or alternative embodiments thereof suitable for the jet propulsion system to be modified), the linkages 246 and the actuator 226.

FIGS. 19 to 26 illustrate alternative embodiments of the jet propulsion system 84 described above. These embodiments use components similar or identical to those of the jet propulsion system 84 described above. As such these components have been labelled with the same reference number as in the embodiment described above and will not be described again in detail.

Figure 19:
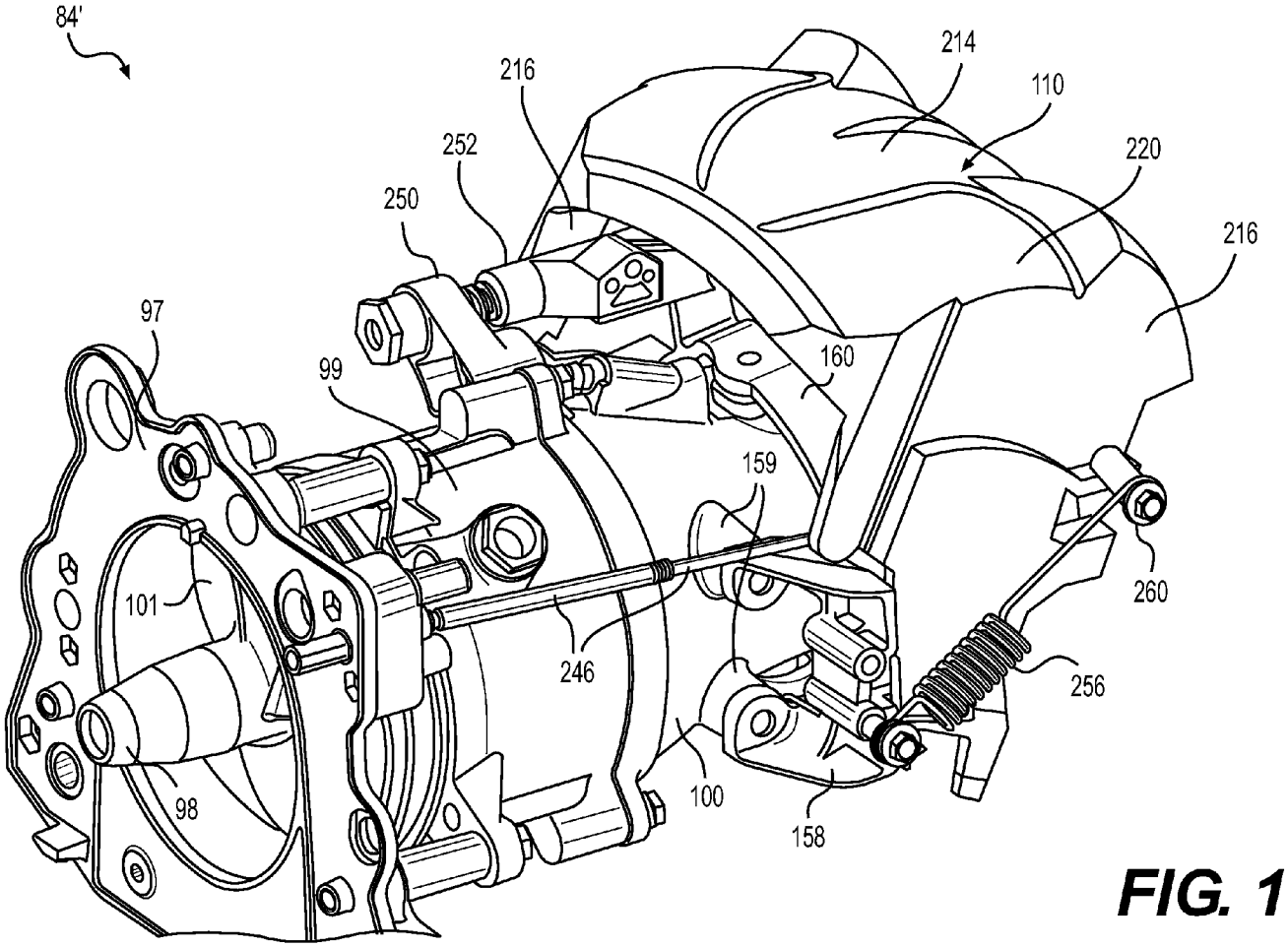
FIG. 19 is a perspective view taken from a front, left side of an alternative embodiment of the jet propulsion system of FIG. 8 with the reverse gate in a stowed position.
Figure 20:
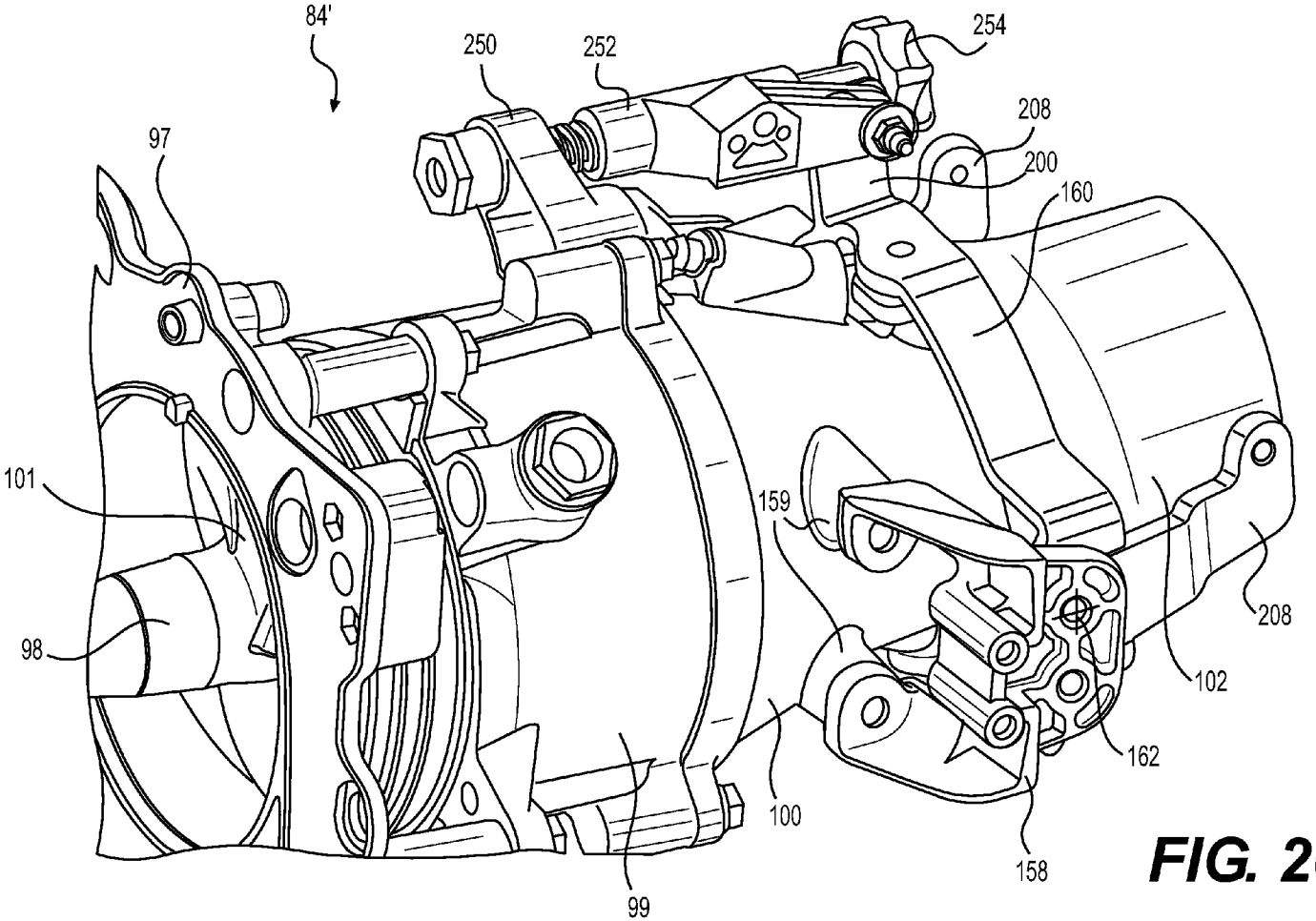
FIG. 20 is a perspective view taken from a front, left side of the jet propulsion system of FIG. 19 with the reverse gate removed.

FIGS. 19 and 20 illustrate a jet propulsion system 84' where the trim position of the VTS support 160 and the steering nozzle 102 is manually set by the user of the watercraft prior to use. As such, movement of the reverse gate 110 has no effect on the trim position. In this embodiment, the rollers 210 have been removed from the VTS support 160, as can be seen in FIG. 20, such that there is no interaction between the VTS support 160 and the abutment surfaces 230, 232, 234 of the reverse gate 110. A bracket 250 is connected to the venturi 100. Alternatively, the bracket 250 could be connected to the right side bracket 158 or to both the venturi 100 and the right side bracket 158. A lead screw assembly 252 is connected between the bracket 250 and the tab 200 of the VTS support 160 as shown. The lead screw assembly 252 has a knob 254 that can be turned by a user of a watercraft to adjust the distance between the aperture 202 of the tab 200 and the bracket 250, thereby adjusting the angular position of the VTS support 160 and steering nozzle 102 about the VTS axis 162. A spring 256 is connected between a fastener 258 inserted in the lower ones of the bores 180 of the side bracket 158 and a pin 260 extending from the side wall 216 of the reverse gate 110 on a left side of the jet propulsion system 84'. It is contemplated that the spring 256 could be provided in the same manner on the right side of the jet propulsion system 84' or that springs 256 could be provide on both sides of the jet propulsion system 84'. The springs 260 are biased so as to help maintain the reverse gate 110 in position when it is in its fully raised position and in its fully lowered position. It is contemplated that the springs 260 could be omitted.

It is contemplated that an alternative embodiment of the jet propulsion system 84' could be provided that would not have the reverse gate 110. Such an embodiment would look like the illustration in FIG. 20.

Figure 21:
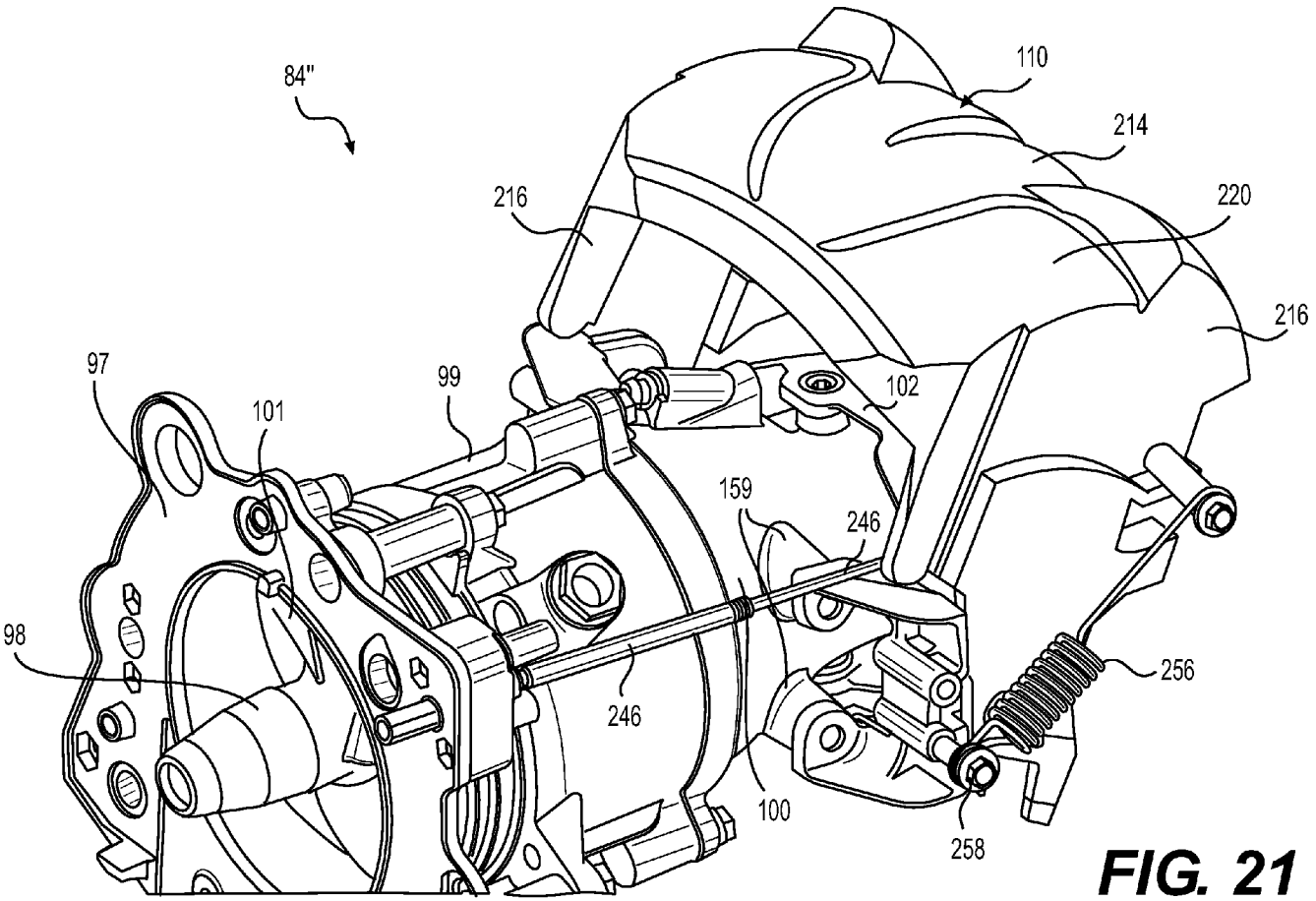
FIG. 21 is a perspective view taken from a front, left side of another alternative embodiment of the jet propulsion system of FIG. 8 with the reverse gate in the stowed position.
Figure 22:
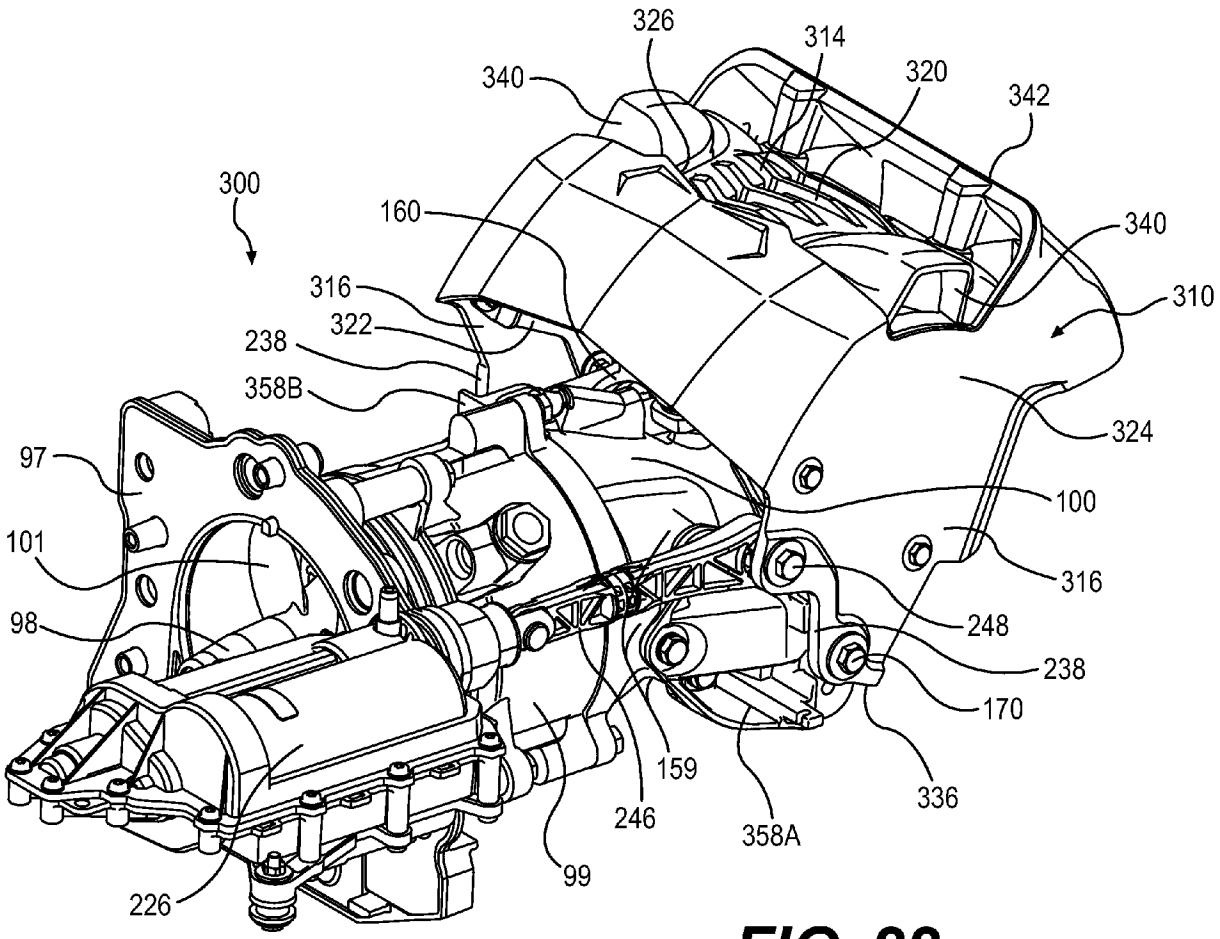
FIG. 22 is a perspective view, taken from a front, left side, of another alternative embodiment of the jet propulsion system of FIG. 8 with the reverse gate in a stowed position.

FIG. 21 illustrates a jet propulsion system 84" where the steering nozzle 102 cannot be trimmed. As such, the VTS support 160 from the jet propulsion system 84 has been omitted and the steering nozzle 102 has been rotationally connected directly to the venturi 100 with the fasteners 166. The reverse gate 110 is mounted to the side brackets 158 as in the previous embodiments and is provided with the springs 256 of the jet propulsion system 84'.

FIGS. 22 to 25B illustrate a jet propulsion system 300. The jet propulsion system 300 is similar to the jet propulsion 84 except that the brackets 158 have been replaced by brackets 358A and 358B and the reverse gate 110 has been replaced by a reverse gate 310.

Figure 23:
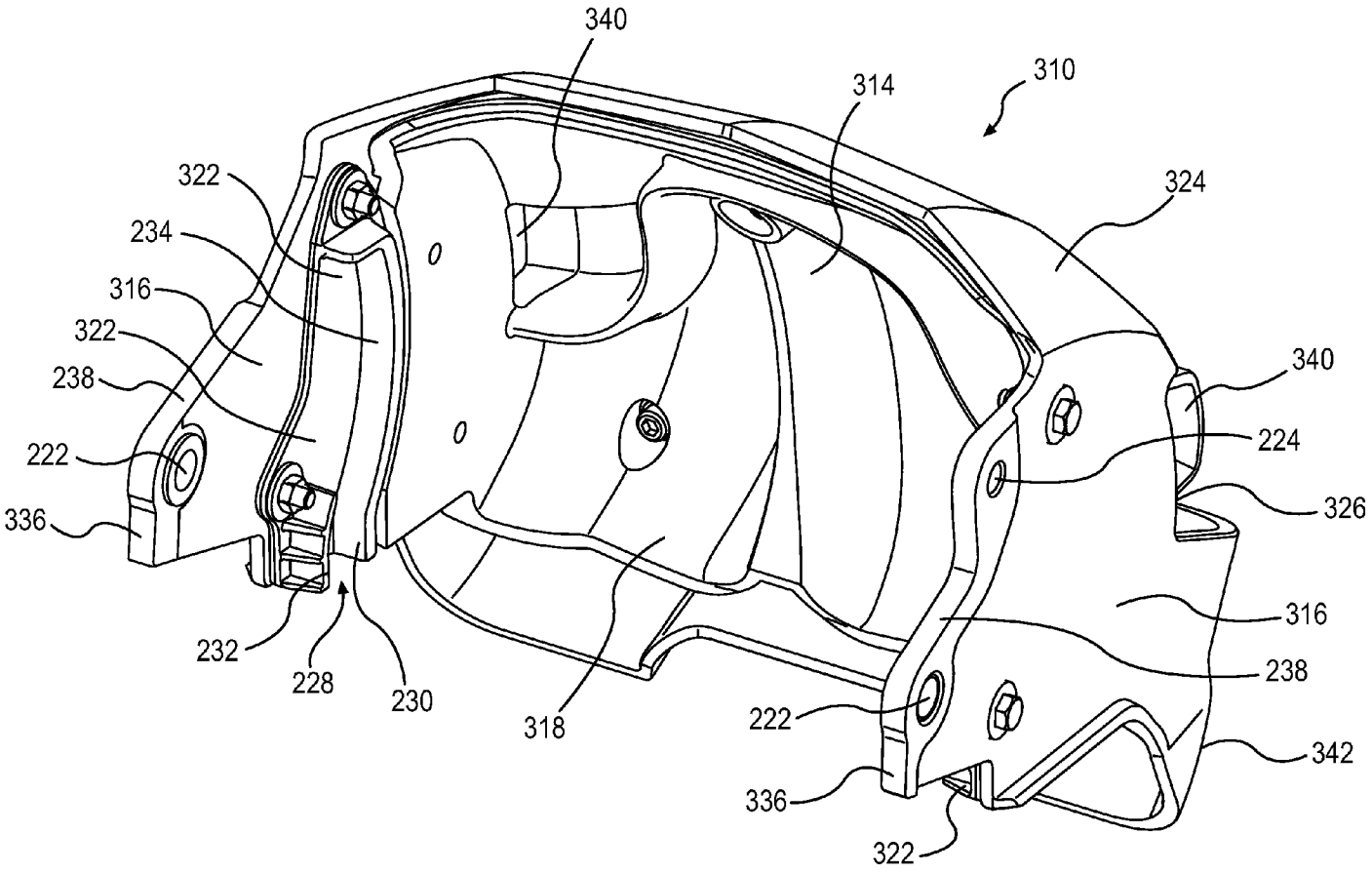
FIG. 23 is a perspective view taken from a front, left side of a reverse gate of the jet propulsion system of FIG. 22.
Figure 24:
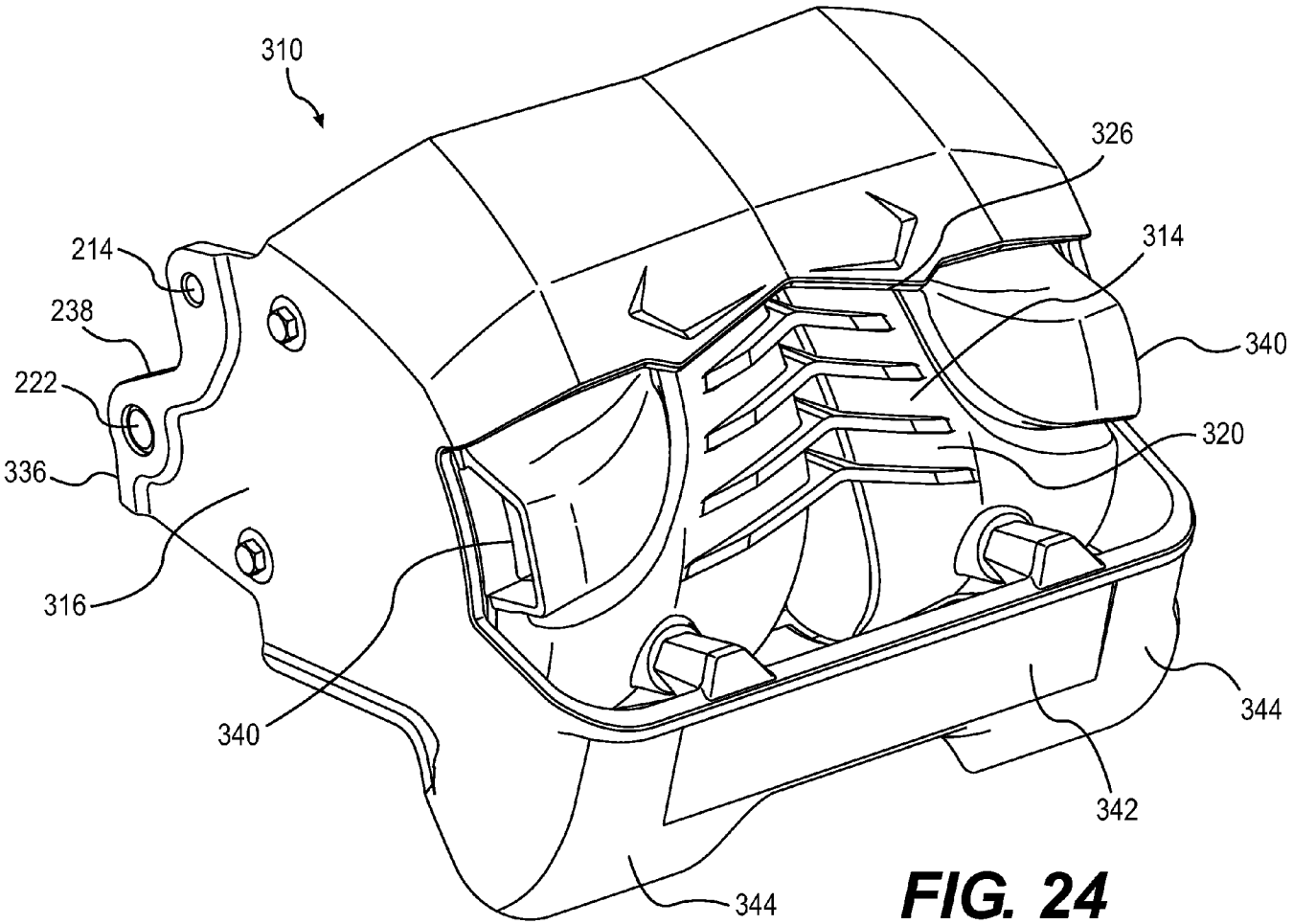
FIG. 24 is a perspective view taken from a rear, left side of the reverse gate of FIG. 23.

As can be seen in FIGS. 23 and 24, the reverse gate 310 is made of a reverse gate body 314, left and right tracks 322 and a shell 324. The reverse gate body 314 and the tracks 322 are made of plastic. It is contemplated that the reverse gate body 314 and the tracks 322 could be made of metal or another material. The shell 324 is made of metal. It is contemplated that the shell 324 could be made of plastic or another material.

The reverse gate body 314 has an inner arcuate surface 318 and an outer arcuate surface 320. When the reverse gate 310 is rotated about the reverse gate axis 168 such that at least a portion of the inner arcuate surface 318 faces at least a portion of the outlet of the steering nozzle 102, the inner arcuate surface 318 redirects at least a portion of a jet of water being expelled from the steering nozzle 102. The reverse gate body 314 also defines two apertures 340. The apertures 340 create a lateral jet of water when the reverse gate 310 is lowered and the steering nozzle 102 is turned while the jet pump 99 is in operation, thus assisting in steering of the watercraft 10. The reverse gate body 314 is disposed inwardly of the shell 324 and is fastened thereto.

The shell 324 has two side walls 316. Each side wall 316 has the aperture 222 used to connect the reverse gate 310 to the side brackets 358A, 358B about the reverse gate axis 168 using the fasteners 170. The left side wall 316 also has the aperture 224 used to operatively connect the reverse gate 310 to the actuator 226. It is contemplated that both side walls 316 could have apertures 224 or that only the right side wall 316 could have the aperture 224. Each side wall 316 also defines a surface 336 that abuts its corresponding lower reverse gate stopper 190 when the reverse gate 310 is in its fully lowered position. Each side wall 316 also defines the surface 238 that abuts its corresponding upper reverse gate stopper 188 when the reverse gate 310 is in its fully raised position. The shell 324 defines a window 326 through which the reverse gate body 314 protrudes partially. The shell 324 also defines a deflector plate 342 similar to the deflector plate 242 described above. It is contemplated that the deflector plate 342 could be a separate part that is fastened to the shell 324 and to the reverse gate body 314. The deflector plate 342 has two deflectors 344 that are spaced from the outer arcuate surface 320 of the reverse gate body 314. The deflectors 344 increase the drag created by the reverse gate 310 in the water when the reverse gate 310 is lowered.

The tracks 322 are fastened to the side walls 316 of the shell 324 on inner sides thereof. Each track 322 defines the channel 228 inside which the corresponding roller 210 of the VTS support 160 is received for certain positions of the reverse gate 110 as described above with respect to the jet propulsion system 84. As in the embodiment above, each channel 228 is defined between a VTS down abutment surface 230 and a VTS up abutment surface 232. However, in the present embodiment, the laterally outward sides of the channels 228 are closed by surfaces of the track 322 extending across the channels 228. Each track 322 is also provided with a VTS hold abutment surface 234. As such, in the jet propulsion system 300, the trim of the steering nozzle 102 is adjusted, via the VTS support 160, by the movement of the reverse gate 310 as in the jet propulsion system 84 described above.

Figure 25B:
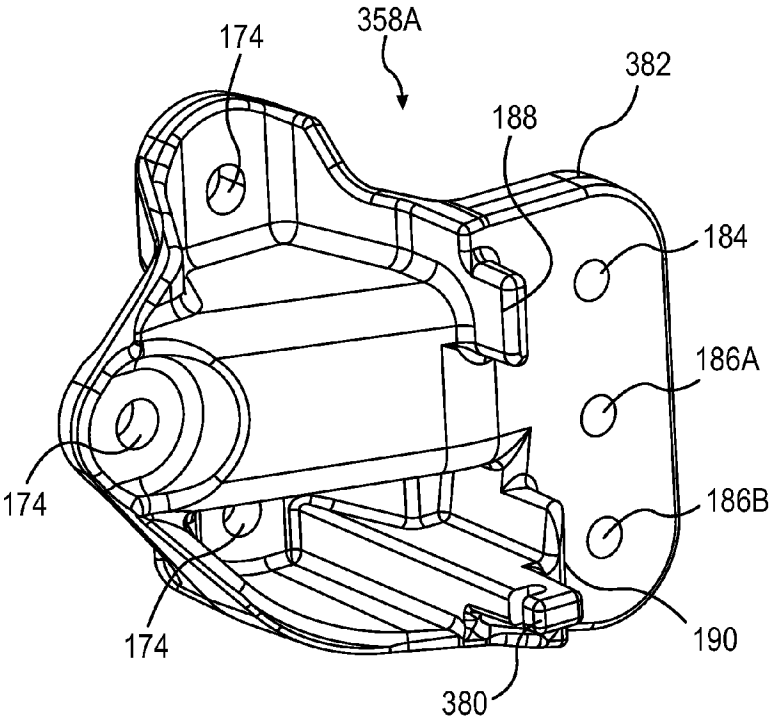
FIG. 25B is a perspective view, taken from a front, left side of the side bracket of FIG. 25A.
Figure 25A:
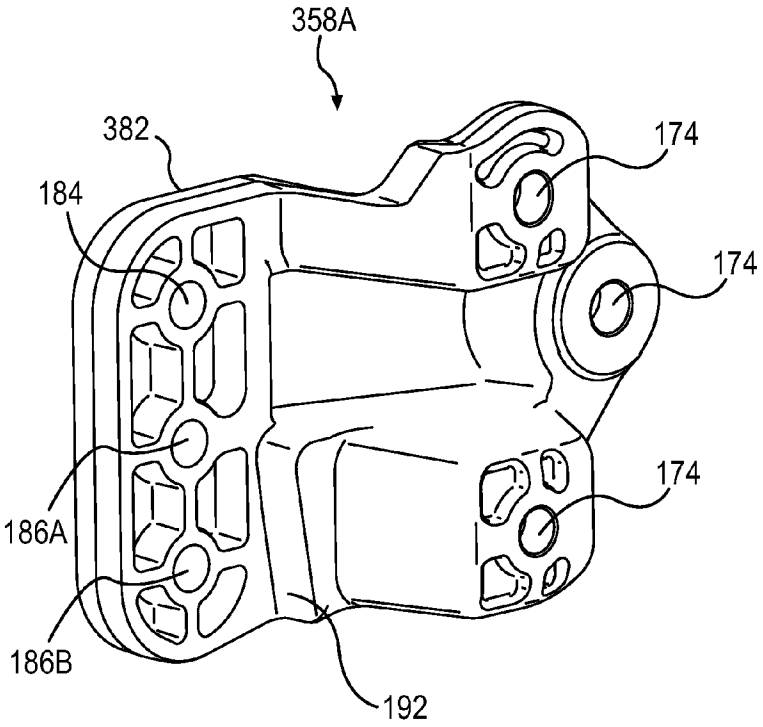
FIG. 25A is a perspective view, taken from a rear, right side of a left side bracket of the jet propulsion system of FIG. 22.

As can be seen in FIGS. 25A and 25B, the left bracket 358A has three apertures 174 defined therein used to fasten the side bracket 358A to three bosses 159 of the venturi 100. A hook 380 is used to attach a spring used in the jet propulsion unit 400 described below. A plate 382 defines vertically spaced apertures 184, 186A and 186B. The aperture 184 is adapted to receive the fastener 164 used to connect the VTS support 160 to the bracket 358A. The aperture 186A is adapted to receive the fastener 170 used to connect the reverse gate 310 to the bracket 358A. The aperture 186B is adapted to receive the fastener 170 used to connect the reverse gate 410 used in the jet propulsion unit 400 described below. The side bracket 358A defines an upper reverse gate stopper 188, a lower reverse gate stopper 190 and a VTS down stopper 192 that server the same functions as those of the side bracket 158.

Although different in overall shape, the right bracket 358B also has three apertures 174, a plate 382, apertures 184, 186A and 186B and stoppers 188, 190 and 192. The bracket 358B does not have the hook 380. The bracket 358B has a protrusion 384 (FIG. 26) that is used in the jet propulsions system 400 as will be described below. It is contemplated that the bracket 358B could have the hook 380 and that the bracket 358A could have the protrusion 384.

It is contemplated that since these features are not used in the jet propulsion system 300, that the apertures 186B, the hook 380 and the protrusion 384 could be omitted from the brackets 358A, 358B.

Figure 26:
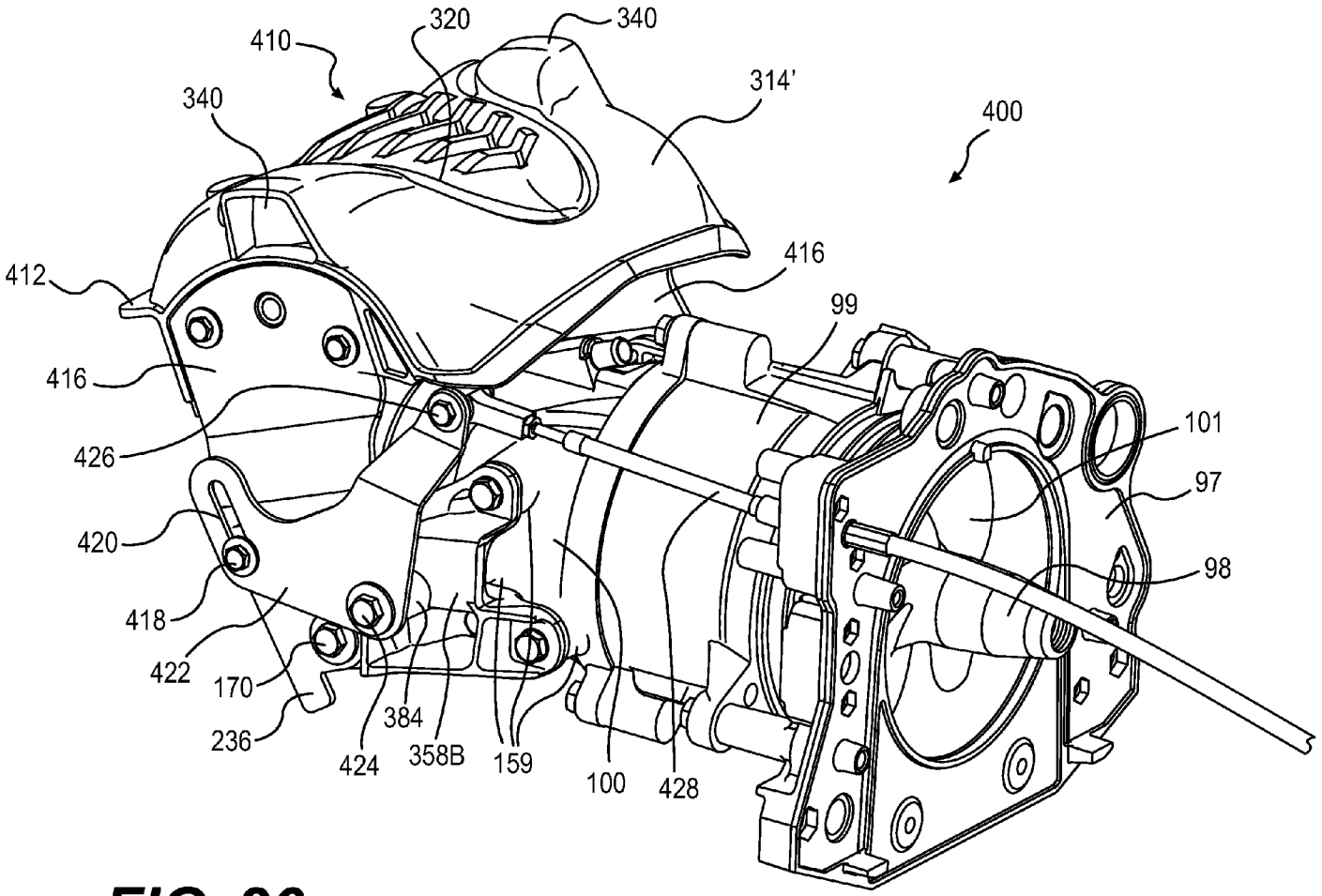
FIG. 26 is a perspective view, taken from a front, right side, of another alternative embodiment of the jet propulsion system of FIG. 8 with the reverse gate in a stowed position.

FIG. 26 illustrates a jet propulsion system 400. This embodiment uses components similar or identical to those of the jet propulsion systems 84 and 300 described above. As such these components have been labelled with the same reference number as in the embodiments described above and will not be described again in detail.

In the jet propulsion system 400, the steering nozzle 102 cannot be trimmed. As such, the VTS support 160 from the jet propulsion system 84 has been omitted and the steering nozzle 102 has been rotationally connected directly to the venturi 100 with the fasteners 166. Also, the brackets 158 have been replaced by the brackets 358A and 358B described above and the reverse gate 110 has been replaced by a reverse gate 410. The reverse gate 410 has a reverse gate body 314' and two side walls 416.

The reverse gate body 314' is similar to the reverse gate body 314 described above, but is provided with a lip 412 at a bottom thereof. The lip 412 helps to prevent the reverse gate 410 from being lowered inadvertently during operation. If the reverse gate 410 were to lower during operation of the jet pump 99, the lip 412 will come in contact with the jet of water exiting the steering nozzle 102. The force of the jet of water acting on the lip 412, and therefore the reverse gate 410, will thereby push back the reverse gate 410 toward a stowed position.

The side walls 416 are made of metal and are fastened to both sides of the reverse gate body 314'. The side walls 416 are connected via fasteners 170 to the apertures 186B of the brackets 358A, 358B. As they are not being used in this embodiment, it is contemplated that the apertures 184 and 186A of the bracket 358A, 358B could be omitted.

The left side wall 416 has a fastener (not shown) extending therefrom. A spring (not shown), similar to the spring 256 described above, extends between this fastener and the hook 380 of the bracket 358A. The spring is biased so as to help maintain the reverse gate 410 in position when it is in its fully raised position and in its fully lowered position.

The right side wall 416 has a fastener 418 extending therefrom. The fastener 418 is slidably received in a slot 420 of an arm 422. The arm 422 is pivotally connected to the protrusion 384 of the bracket 358B by a fastener 424. The upper end 426 of the arm 422 is pivotally fastened to the end of a push-pull cable 428. By actuating the push-pull cable 428 (i.e. causing it to move forward or backward), the arm 422 pivots about the pivot axis defined by the fastener 424 which in turn causes the reverse gate 410 to pivot about the reverse gate axis 168 defined by the apertures 186B.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A watercraft comprising:

a hull forming a tunnel;

a deck disposed on the hull;

an engine compartment defined between the hull and the deck;

an engine disposed in the engine compartment;

a steering assembly disposed at least in part on the deck;

a jet pump connected to the hull, the jet pump being disposed in the tunnel, and the jet pump being operatively connected to the engine;

a venturi connected to a rearward end of the jet pump and being disposed at least in part in the tunnel;

a left side bracket connected to a left side of the venturi;

a right side bracket connected to a right side of the venturi;

a variable trim system (VTS) support rotationally mounted to the left and right side brackets about a VTS axis, the VTS axis extending generally laterally and horizontally;

a steering nozzle rotationally mounted to the VTS support about a steering axis such that the steering nozzle rotates about the VTS axis with the VTS support, the steering axis being generally perpendicular to the VTS axis, the steering nozzle being operatively connected to the steering assembly and being disposed at least in part rearwardly of the venturi;

a gate rotationally mounted to the left and right side brackets about a gate axis, the gate axis extending generally laterally and horizontally, the gate being operatively connected to the VTS support such that rotation of the gate about the gate axis results in rotation of the VTS support about the VTS axis; and an actuator operatively connected to the gate to rotate the gate about the gate axis, the gate being operatively connected between the actuator and the VTS support.

2. The watercraft of claim 1, further comprising:

at least one follower extending from one of the VTS support and the gate; and at least one abutment surface disposed on an other one of the VTS support and the gate, the at least one follower abutting the at least one abutment surface through at least a range of rotation of the gate;

wherein rotation of the gate about the gate axis results in a displacement of the at least one follower along the at least one abutment surface, and the displacement of the at least one follower along the at least one abutment surface results in rotation of the VTS support about the VTS axis.

3. The watercraft of claim 2, wherein the at least one abutment surface is disposed on the gate and the at least one follower is disposed on the VTS support.

4. The watercraft of claim 2, wherein the at least one abutment surface is at least one first abutment surface;

the watercraft further comprising at least one second abutment surface disposed on the other one of the VTS support and the gate, the at least one second abutment surface extending from the at least one first abutment surface;

wherein rotation of the gate about the gate axis through a first range of angles results in the displacement of the at least one follower along the at least one first abutment surface, and the displacement of the at least one follower along the at least one first abutment surface results in rotation of the VTS support about the VTS axis; and wherein rotation of the gate about the gate axis through a second range of angles results in a displacement of the at least one follower along the at least one second abutment surface, and the displacement of the at least one follower along the at least one second abutment surface maintaining the VTS support in position.

5. The watercraft of claim 4, wherein the displacement of the at least one follower along the at least one second abutment surface maintains the VTS support in a fully lowered position.

6. The watercraft of claim 4, wherein the at least one second abutment surface is an arcuate surface having the gate axis as a center of curvature.

7. The watercraft of claim 6, wherein the at least one first abutment surface is straight.

8. The watercraft of claim 1, wherein rotation of the gate between a first angle and a second angle causes a rotation of the VTS support about the VTS axis;

wherein positions of the gate between the first and second angles are stowed positions;

wherein the VTS support remains in a fixed position during rotation of the gate between the second angle and a third angle; and wherein positions of the gate between the second angle and the third angle are positions where the gate redirects a jet of water expelled from the steering nozzle when the engine is in operation.

9. The watercraft of claim 1, wherein the VTS support is a VTS ring encircling at least a portion of the steering nozzle; and wherein the steering nozzle is rotationally mounted to the VTS ring about the steering axis at a top and at a bottom of the VTS ring.

10. The watercraft of claim 1, wherein the gate axis is offset from the VTS axis.

11. The watercraft of claim 10, wherein the gate axis is vertically lower than the VTS axis.

12. The watercraft of claim 1, wherein:

the left side bracket is disposed between the gate and the VTS support;

the right side bracket is disposed between the gate and the VTS support; and the VTS support is disposed between the left and right side brackets.

13. The watercraft of claim 1, wherein at least one of the left and right side brackets includes at least one stopper; and wherein the at least one stopper abuts at least one of the VTS support and the gate to limit rotation of the at least one of the VTS support and the gate in a least one direction.

14. The watercraft of claim 2, wherein the at least one abutment surface is at least one first abutment surface;

the watercraft further comprising at least one second abutment surface disposed on the other one of the VTS support and the gate, wherein the at least one follower abuts the at least one first abutment surface when the gate rotates in a first direction and the at least one follower abuts the at least one second abutment surface when the gate rotates in a second direction opposite the first direction;

wherein rotation of the gate about the gate axis in the first direction results in the displacement of the at least one follower along the at least one first abutment surface, and the displacement of the at least one follower along the at least one first abutment surface results in rotation of the VTS support about the VTS axis in the first direction; and wherein rotation of the gate about the gate axis in the second direction results in the displacement of the at least one follower along the at least one second abutment surface, and the displacement of the at least one follower along the at least one second abutment surface results in rotation of the VTS support about the VTS axis in the second direction.

15. The watercraft of claim 14, wherein the at least one first and second abutment surfaces define a channel; and wherein the at least one follower is received in the at least one channel.

16. The watercraft of claim 1, wherein the gate includes:

a gate body having an inner surface and an outer surface; and at least one deflector connected to the outer surface of the gate body.

17. A variable trim system and gate assembly for a watercraft jet propulsion system comprising:

a left side bracket adapted to be connected to a left side of a venturi of the jet propulsion system, the left side bracket defining a first aperture and a second aperture;

a right side bracket adapted to be connected to a right side of the venturi, the right side bracket defining a first aperture and a second aperture;

a variable trim system (VTS) support rotationally mounted to the left and right side brackets about a generally laterally and horizontally extending VTS axis, the VTS support being fastened to the left and right side brackets via the first apertures, the VTS support being adapted to rotationally mount a steering nozzle to the VTS support about a steering axis, the steering axis being generally perpendicular to the VTS axis; and a gate rotationally mounted to the left and right side brackets about a generally laterally and horizontally extending gate axis such that rotation of the gate about the gate axis results in rotation of the VTS support about the VTS axis, the gate being fastened to the left and right side brackets via the second apertures, the gate being adapted to be connected to an actuator such that the gate is operatively connected between the actuator and the VTS support.

18. The variable trim system and gate assembly of claim 17, further comprising the venturi;

wherein the left side bracket is connected to the left side of the venturi; and wherein the right side bracket is connected to the right side of the venturi.

19. The variable trim system and gate assembly of claim 17, further comprising:

at least one follower extending from one of the VTS support and the gate; and at least one abutment surface disposed on an other one of the VTS support and the gate, the at least one follower abutting the at least one abutment surface through at least a range of rotation of the gate;

wherein rotation of the gate about the gate axis results in a displacement of the at least one follower along the at least one abutment surface, and the displacement of the at least one follower along the at least one abutment surface results in rotation of the VTS support about the VTS axis.

20. The variable trim system and gate assembly of claim 19, wherein the at least one abutment surface is disposed on the gate and the at least one follower is disposed on the VTS support.

21. The variable trim system and gate assembly of claim 19, wherein the at least one abutment surface is at least one first abutment surface;

the variable trim system and gate assembly further comprising at least one second abutment surface disposed on the other one of the VTS support and the gate, the at least one second abutment surface extending from the at least one first abutment surface;

wherein rotation of the gate about the gate axis through a first range of angles results in the displacement of the at least one follower along the at least one first abutment surface, and the displacement of the at least one follower along the at least one first abutment surface results in rotation of the VTS support about the VTS axis; and wherein rotation of the gate about the gate axis through a second range of angles results in a displacement of the at least one follower along the at least one second abutment surface, and the displacement of the at least one follower along the at least one second abutment surface maintaining the VTS support in position.

22. The variable trim system and gate assembly of claim 19, wherein the at least one abutment surface is at least one first abutment surface;

the variable trim system and gate assembly further comprising at least one second abutment surface disposed on the other one of the VTS support and the gate, wherein the at least one follower abuts the at least one first abutment surface when the gate rotates in a first direction and the at least one follower abuts the at least one second abutment surface when the gate rotates in a second direction opposite the first direction;

wherein rotation of the gate about the gate axis in the first direction results in the displacement of the at least one follower along the at least one first abutment surface, and the displacement of the at least one follower along the at least one first abutment surface results in rotation of the VTS support about the VTS axis in the first direction; and wherein rotation of the gate about the gate axis in the second direction results in the displacement of the at least one follower along the at least one second abutment surface, and the displacement of the at least one follower along the at least one second abutment surface results in rotation of the VTS support about the VTS axis in the second direction.

23. The variable trim system and gate assembly of claim 17, wherein the gate axis is offset from the VTS axis.

24. The variable trim system and gate assembly of claim 17, wherein rotation of the gate between a first angle and a second angle causes a rotation of the VTS support about the VTS axis;

wherein positions of the gate between the first and second angles are stowed positions;

wherein the VTS support remains in a fixed position during rotation of the gate between the second angle and a third angle; and wherein positions of the gate between the second angle and the third angle are positions where the gate redirects a jet of water expelled from the steering nozzle when the watercraft jet propulsion system is in operation.

25. The watercraft of claim 1, wherein the left side bracket defines a first aperture and a second aperture;

wherein the right side bracket defines a first aperture and a second aperture;

wherein the VTS support is fastened to the left and right side brackets via the first apertures; and wherein the gate is fastened to the left and right side brackets via the second apertures.

26. The watercraft of claim 1, wherein the VTS axis and the gate axis are fixed relative to the venturi.

* * * * *